US005501536A

United States Patent [19]

Kleve

[11] Patent Number: 5,501,536

[45] Date of Patent: Mar. 26, 1996

[54] TYPEWRITER CARTRIDGE APPARATUS HAVING AN OUTER HOUSING WITH INNER LOOP ATTACHED RIBBON CARTRIDGE

[76] Inventor: Robert E. Kleve, 1103 24th Ave. S., Grand Forks, N. Dak. 58201

[21] Appl. No.: 33,896

[22] Filed: Mar. 18, 1993

Related U.S. Application Data

[63] Continuation-in-part of Ser. No. 602,734, Oct. 24, 1990, abandoned, which is a continuation-in-part of Ser. No. 269,972, Nov. 10, 1988, abandoned.

[51] Int. Cl.[6] ..... B41J 32/00

[52] U.S. Cl. ..... 400/208; 400/234; 400/248

[58] Field of Search ..... 400/207, 208, 400/208.1, 223, 234, 248

[56] References Cited

U.S. PATENT DOCUMENTS

| | | | |
|---|---|---|---|
| 4,058,197 | 11/1977 | West | 400/234 |
| 4,213,715 | 7/1980 | Haftman et al. | 400/207 |
| 4,367,963 | 1/1983 | Daughters | 400/207 |
| 4,502,801 | 3/1985 | Hefti et al. | 400/208 |
| 4,568,210 | 2/1986 | Printera | 400/208 |
| 4,623,273 | 11/1986 | Gubau | 400/235.1 |
| 4,655,623 | 4/1987 | Gasser | 400/208 |
| 4,770,553 | 9/1988 | Deschamps et al. | 400/208 |
| 4,840,504 | 6/1989 | Chu et al. | 400/208 |
| 4,861,177 | 8/1989 | Heins et al. | 400/208 |
| 4,990,006 | 2/1991 | Haftmann et al. | 400/208 |

*Primary Examiner*—Stephen Funk
*Attorney, Agent, or Firm*—Robert E. Kleve

[57] ABSTRACT

A tape cartridge for use with typewriters, printers, and the like having reusable or non-reusable tape or ribbon. The cartridge has a housing and a take up reel drive member, take up reel post, and supply reel post within the housing. The cartridge has a detachable sub cartridge detachable within the housing. The sub cartridge has a take up reel and supply reel each on hubs, a panel connecting the hubs together, and a reel of tape wound on the supply reel. The sub cartridge's hubs are detachably mounted to the posts of the cartridge housing to detachably mount the sub cartridge to the housing of the cartridge. The cartridge housing has spaced ribbon guides to guide the tape or ribbon of the sub cartridge from the supply reel to the take up reel of the sub cartridge. The cartridge housing has a sufficient opening between the housing and sub cartridge to enable an intermediate portion of the tape to be looped about the housing guides after the sub cartridge is mounted to the housing, with ends of the tape remaining attached to the reels within the confines of the panel. A spring urged member urges the take up reel of the sub cartridge and drive member of the housing together. A release lever on the housing releasably holds the sub cartridge take up reel and drive member apart.

5 Claims, 10 Drawing Sheets

FIG.1
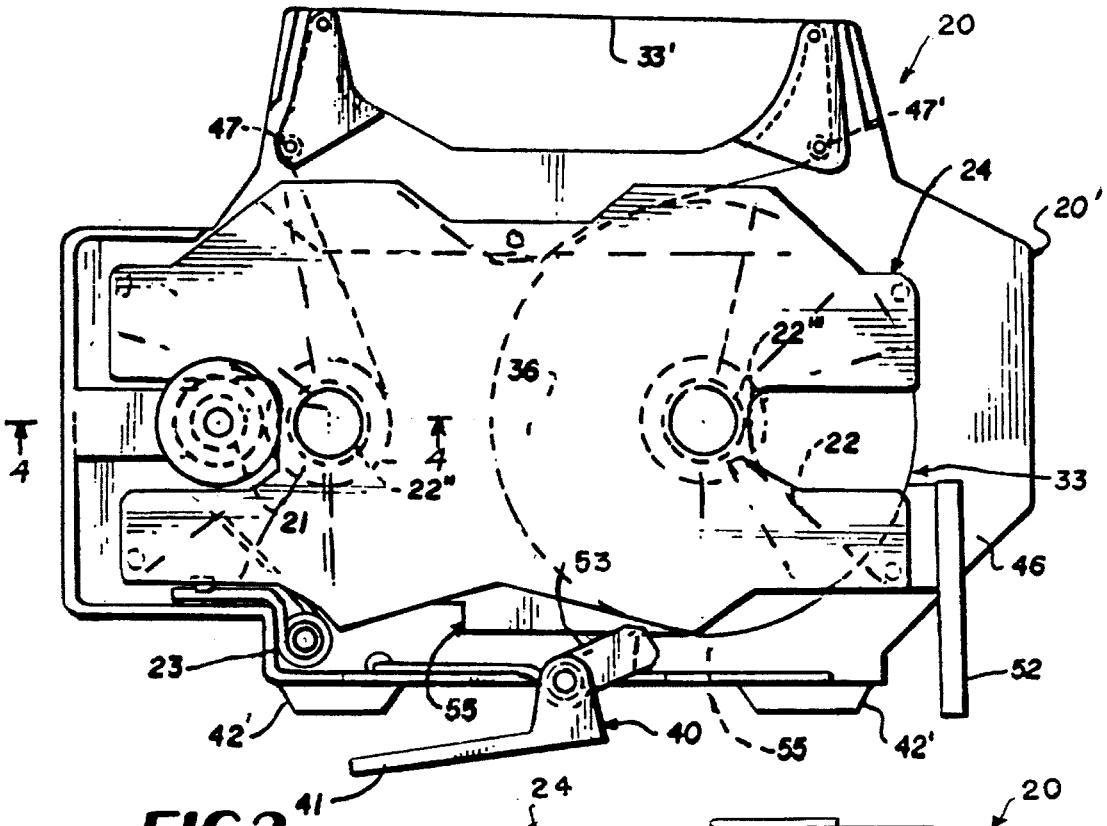
FIG.2
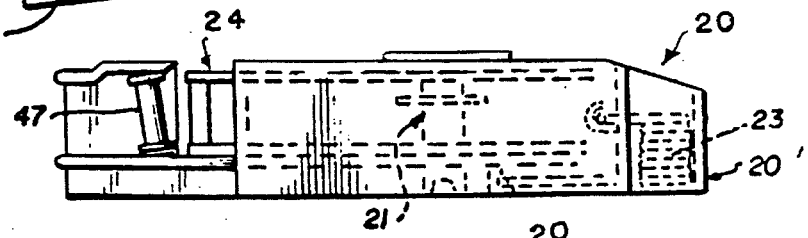
FIG.3
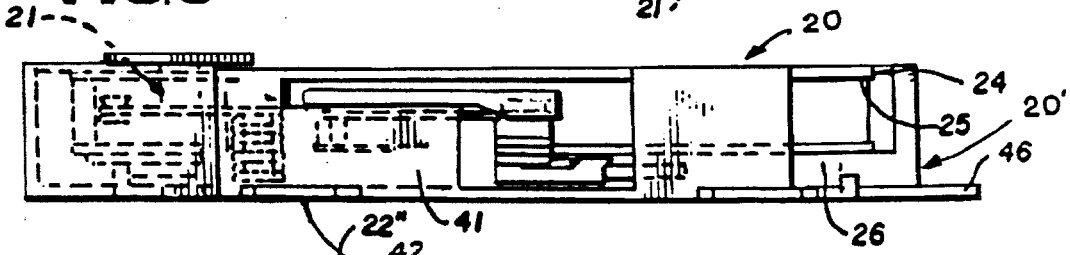
FIG.4
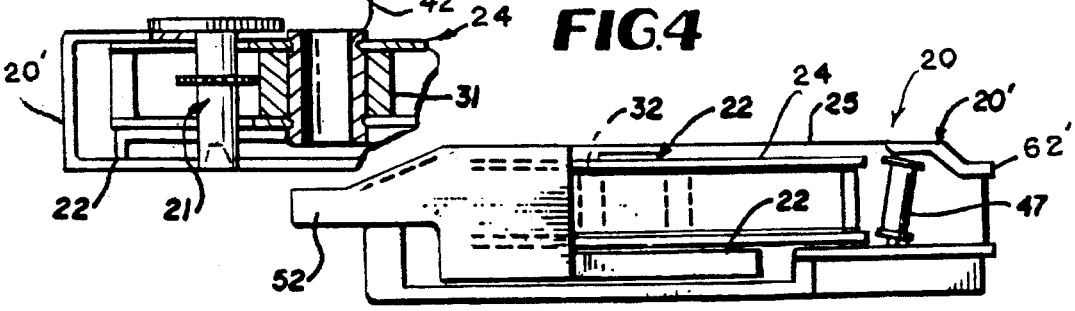
FIG.5

FIG.11(d)
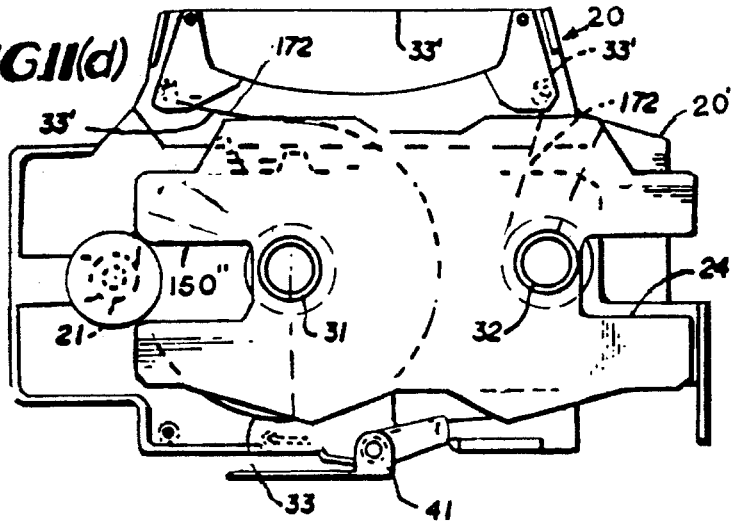
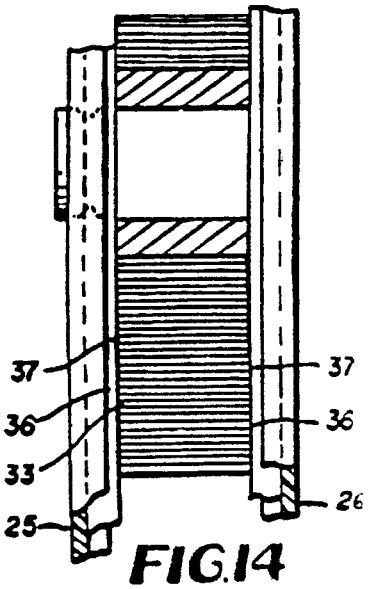
FIG.14
FIG.12
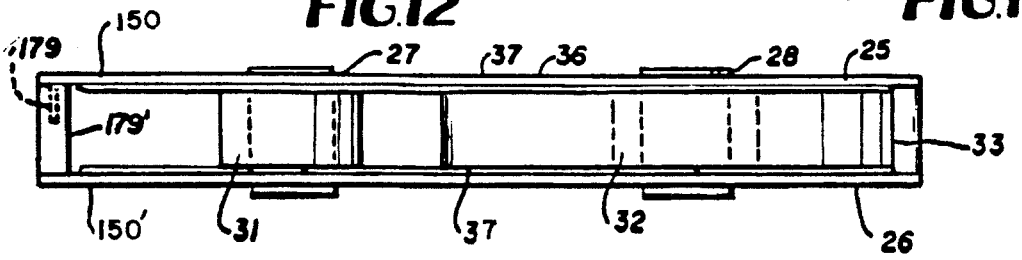
FIG.13
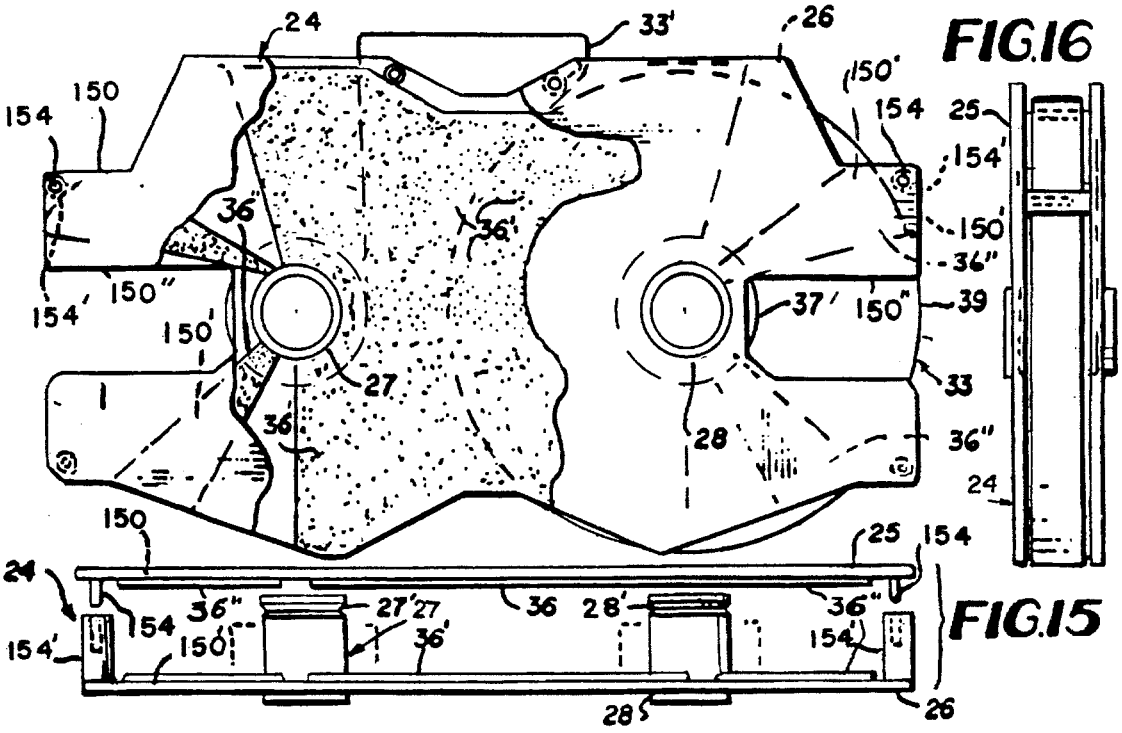
FIG.16
FIG.15

FIG.28(d)
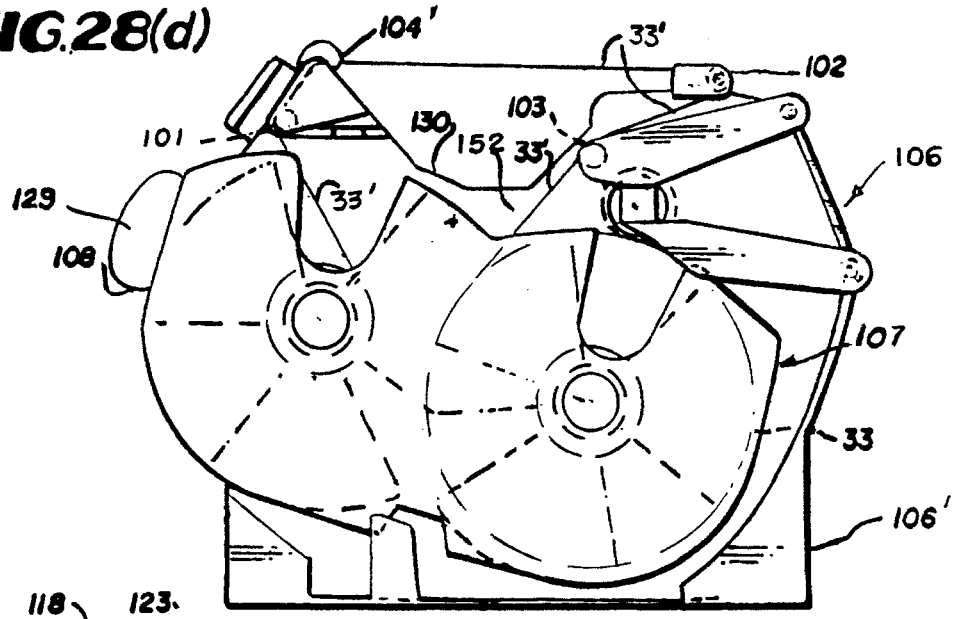
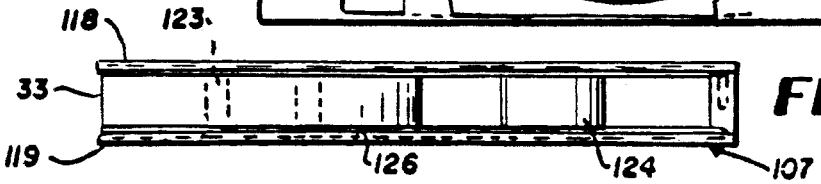
FIG.31
FIG.32(a)
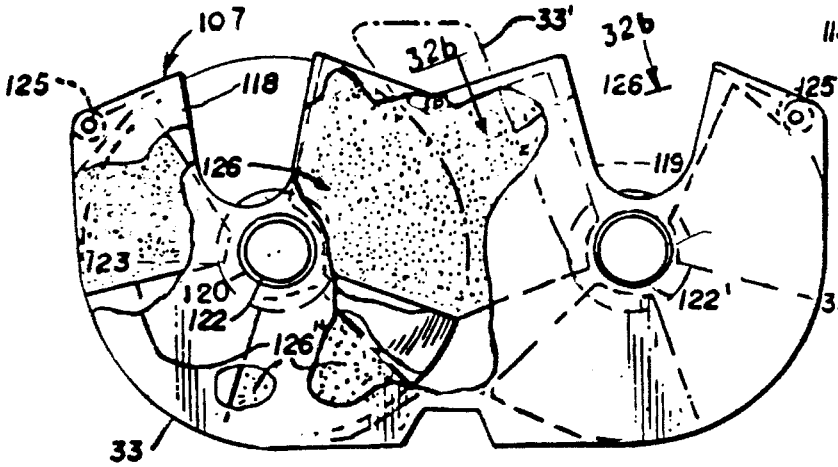
FIG.29
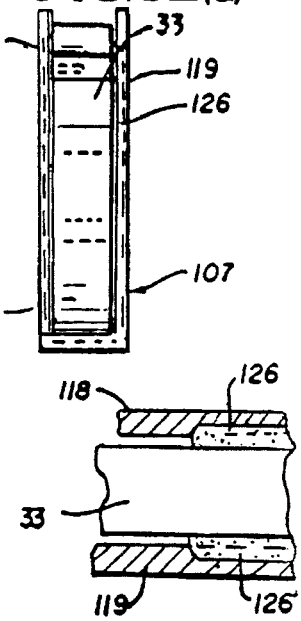
FIG.32(b)
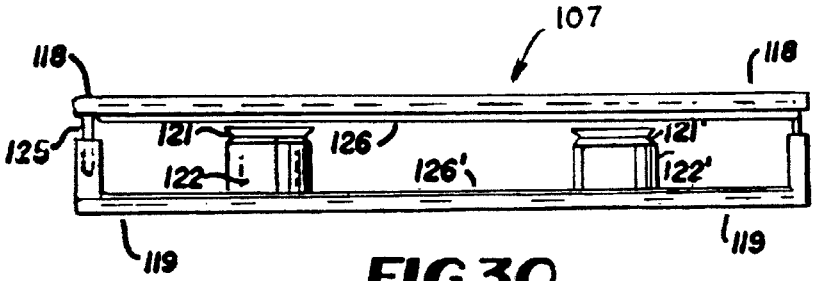
FIG.30

FIG.39
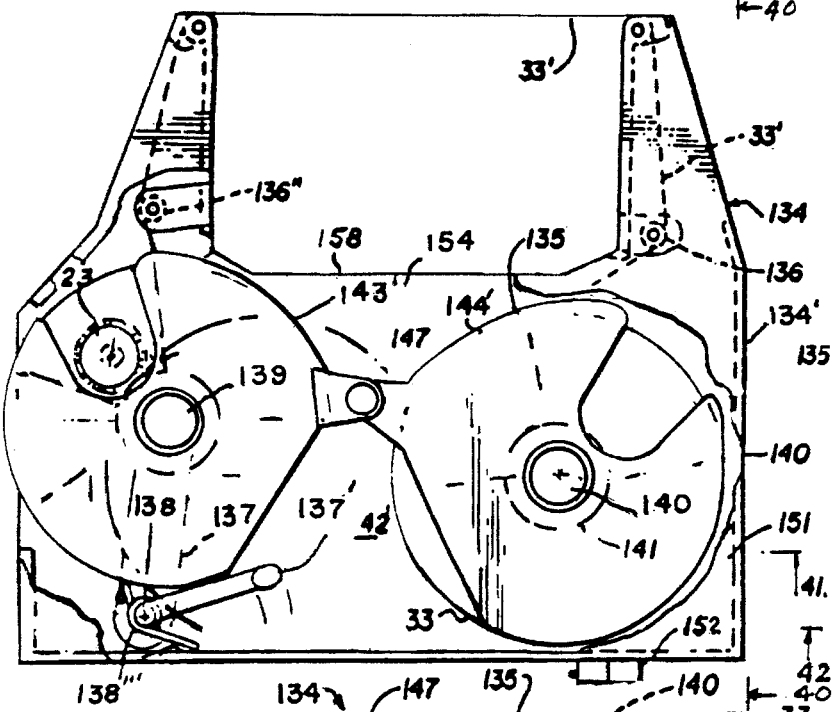
FIG.40
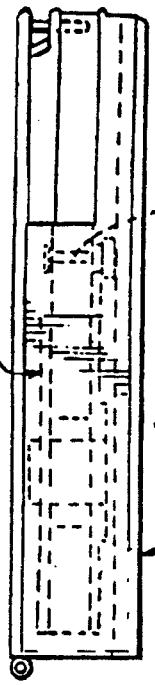
FIG.46
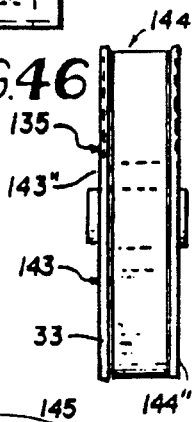
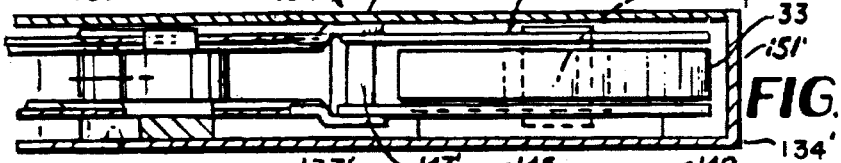
FIG.41
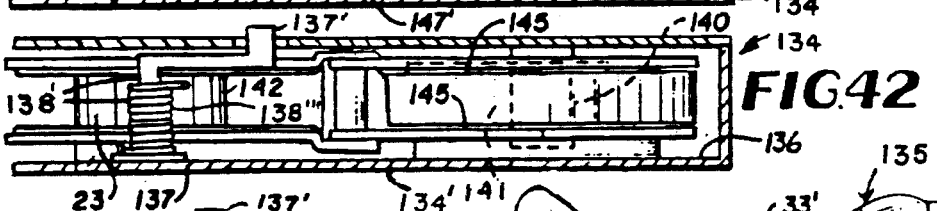
FIG.42
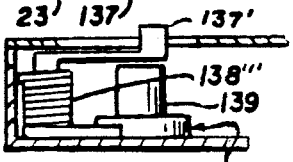
FIG.44
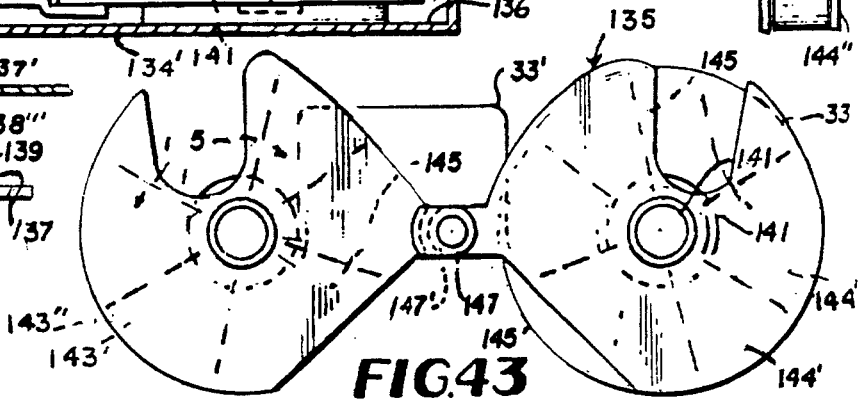
FIG.43
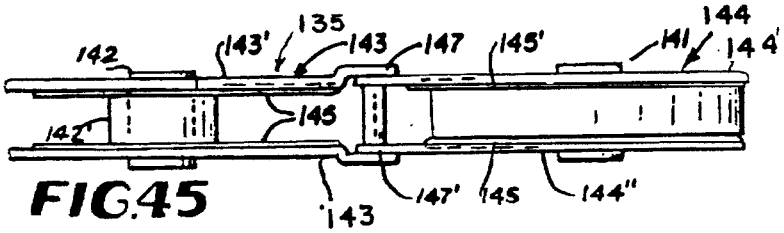
FIG.45

TYPEWRITER CARTRIDGE APPARATUS HAVING AN OUTER HOUSING WITH INNER LOOP ATTACHED RIBBON CARTRIDGE

This application is a continuation in part of my patent application Ser. No. 602,734, Filed: Oct. 24, 1990, now abandoned, which is a continuation in part of my patent application Ser. No. 269,972, Filed: Nov. 10, 1988, now abandoned.

This invention relates to cartridge or container apparatus.

It is an object of the invention to provide a novel tape cartridge which reduces replacement cost.

It is a further object of the invention to provide a novel container for detachably receiving a sub container that may be revsersably mounted therein, and a novel method of detachably mounting it.

It is a further object of the invention to provide a novel cotainer detachably receiving a sub container of ribbon with convenient handle means for receiving, engaging, and disengaging the sub container with the container.

It is a further object of the invention to provide a novel tape cartridge with a replacable tape on a sub cartridge, separate and removable from the cartridge, to eliminate the need to replace the entire cartridge.

It is another object of the invention to provide a novel tape or ribbon cartridge for typewriters, printers, and the like with means to support a tape sub cartridge, means to guide the tape from the sub cartridge along a path traveling past the print wheel of a typewriter for typing thereon, and a sub cartridge removable from the cartridge, along with the used tape, and a new sub cartridge of new, unused tape or ribbon on its supply reel can be attached to the cartridge, so that the same cartridge housing can be used again with a new ribbon or tape.

Further objects and advantages of the invention will become apparent as the description proceeds and when taken in conjunction with the accompanying drawings wherein:

BRIEF DESCRIPTION OF THE DRAWINGS

FIG. 1 is a top plan view of the tape cartridge, illustrating the first form of the cartridge, with a sliding support therein, a sub cartridge mounted on the sliding support, and with a new, unused reel of typewriter ribbon or tape wound on the supply reel of the sub cartridge. The release lever has been pushed clockwise, releasing the sliding support so that it has slid from its right to its left, operative position with the sub cartridge thereon. This places the take up reel of the sub cartridge engaged against the spoke member of the drive member of the cartridge. The cartridge, with the sub cartridge thereon, is ready to be mounted into a print wheel typewriter to be used to type on.

FIG. 2 is a side elevational view of the first form, as illustrated in FIG. 1, along the left side thereof.

FIG. 3 is a rear elevational view, as seen in FIG. 1.

FIG. 4 is a cross-sectional view along line 4—4 of FIG. 1.

FIG. 5 is a right side elevational view, as illustrated in FIG. 1.

FIG. 10(*a*) is an enlarged fragmentary view of the toe and latch lever.

FIG. 10(*b*) is a further enlarged rear view of the toe and latch lever.

FIG. 11(*b*) is a top plan view of the first form of the invention, after the sub cartridge has been mounted to the cartridge and before the tape segment is attached, looped about the ribbon guides of the cartridge.

FIG. 11(*c*) is a top plan view of the first form, after the release lever has been pushed, allowing the spring to return the sliding plate to the left, thereby sliding the sub cartridge thereon to the left, into operative engagement of its take up reel with the drive member of the cartridge, so that the cartridge and sub cartridge are ready to be mounted into a typewriter for use in typing, and after the tape segment has been attached or looped about the guides.

FIG. 11(*d*) is a top plan view of the first form, after substantially all the ribbon from the take up reel has been driven by the drive member onto the take up reel, by typing thereon, while the cartridge and sub cartridge were mounted on a typewriter. The cartridge is therefore ready to be removed from the typewriter; and the sub cartridge is ready to be moved or slid to the right, by pulling the sliding support to the right until it reaches its right, locked position which is the same as illustrated in FIG. 11(*b*), so that the sub cartridge can be removed for exchange or reversal, thereby repeating the cycle shown in FIGS. 11(*a*) to (*c*).

FIG. 12 is an enlarged end view of the sub cartridge.

FIG. 13 is an enlarged side view of the sub cartridge, with a portion broken away.

FIG. 14 is an enlarged fragmentary view taken along line 14—14 of FIG. 13.

FIG. 15 is an exploded view of the sub cartridge.

FIG. 16 is a side view of the sub cartridge.

FIG. 28(*b*) is a top plan view of the third form after the pivot plate has been pivoted to the left, and the sub cartridge mounted thereon.

FIG. 28(*c*) is a top plan view of the third form of the invention, after its spring has pivoted its plate and its sub cartridge to the right with the take up reel of the sub cartridge engaged against the drive of the cartridge. The tape segment between the reels is shown in phantom lines, before it is drawn out for attachment; and it is shown in solid lines, after the segment has been drawn out from the sub cartridge and attached or looped in operative position about the guide rollers of the cartridge.

FIG. 28(*d*) is a top plan view of the third form of the invention, after the cartridge and sub cartridge have been mounted in a typewriter; after the tape on the supply reel of the sub cartridge has been driven onto the take up reel of the sub cartridge from typing from use in a typewriter; after the cartridge and sub cartridge have thereafter been removed from the typewriter, and the cartridge is ready for the handle to be used to move the sliding support slightly further so that the sub cartridge can be removed, reversed, and/or exchanged.

FIG. 29 is a side elevational view of the sub cartridge of the third form of the invention.

FIG. 30 is an exploded end view of the sub cartridge of the third form.

FIG. 31 is an end view of the sub cartridge of the third form.

FIG. 32(*a*) is a side end view of the third form of the invention.

FIG. 32(*b*) is a cross-sectional view taken along line 32(*b*)—32(*b*) of FIG. 29.

FIG. 38(*a*) is a view along line 38(*a*)—38(*a*) of FIG. 33.

FIG. 38(*b*) is a view along line 38(*b*)—38(*b*) of FIG. 33.

FIG. 39 is a top plan view of the fourth form of cartridge and sub cartridge.

FIG. 40 is a view taken along line 40—40 of FIG. 39.

FIG. 41 is a cross-sectional view taken along line 41—41 of FIG. 39.

FIG. 42 is a view taken along line 42—42 of FIG. 39.

FIG. 43 is a top plan view of the sub cartridge of the fourth form.

FIG. 44 is a view of the sub cartridge along line 44—44 of FIG. 39.

FIG. 45 is a side view of the sub cartridge.

FIG. 46 is a side end view of the sub cartridge.

DESCRIPTION OF PREFERRED EMBODIMENT

Figures 6, 7, 8, 9, 10A, 10B:
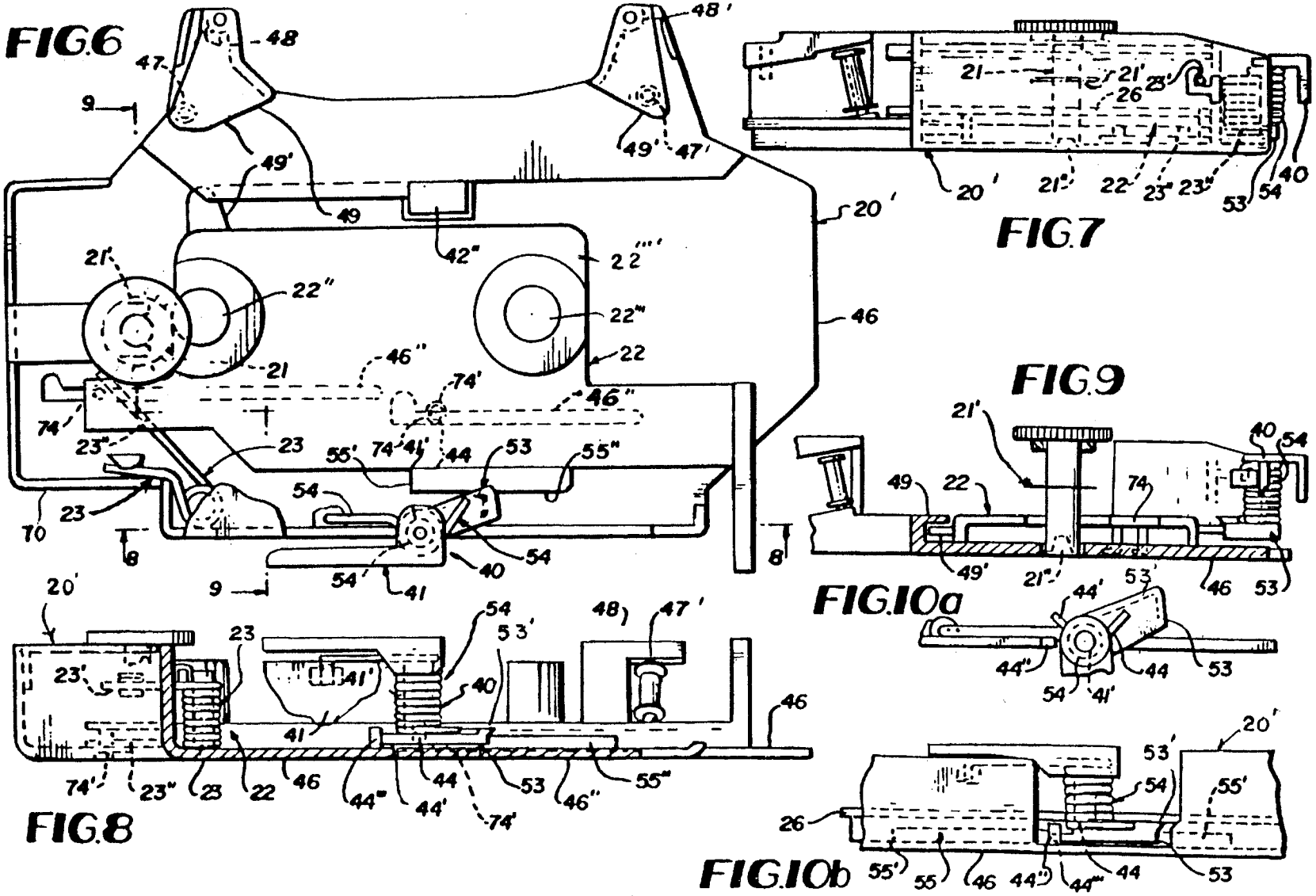
FIG. 6 is an enlarged top plan view of the first form or specie of cartridge.
FIG. 7 is an enlarged right side view of the cartridge and sub cartridge.
FIG. 8 is a cross-sectional view along line 8—8 of FIG. 6.
FIG. 9 is a cross-sectional view along line 9—9 of FIG. 6.

Briefly stated, the invention comprises a tape cartridge for use with typewriters, printers, and the like having reusable or non-reusable tape or ribbon. The cartridge has a housing and a take up reel drive member, take up reel post, and supply reel post within the housing. The cartridge has a detachable sub cartridge detachable within the housing. The sub cartridge has a take up reel and supply reel each on hubs, a panel connecting the hubs together, and a reel of tape wound on the supply reel. The sub cartridge's hubs are detachably mounted to the posts of the cartridge to detachably mount the sub cartridge to the housing of the cartridge. The cartridge housing has spaced ribbon guides to guide the tape from the supply reel to the take up reel of the sub cartridge. The cartridge housing has sufficient opening between the housing and sub cartridge to enable an intermediate portion of the tape to be looped about the housing guides after the sub cartridge is mounted to the housing, with the ends of the tape remaining attached to the reels. A spring urged member urges the take up reel of the sub cartridge and drive member of the housing together. A release lever on the housing releasably holds the sub cartridge's take up reel and drive member apart.

Referring more particularly to the drawings, the first specie and preferred embodiment of the cartridge 20 is illustrated having a cartridge housing 20' with a drive member 21 and a movably mounted sliding support 22 that slides in slots 46" in the back wall 46 of the cartridge housing 20'. The sliding support 22 is spring urged against the drive member 21 by a spring 23. A detachable sub cartridge 24 is detachably mounted to the sliding support 22 of the cartridge housing 20'. The sliding support 22 has a take up reel post support 22" and a supply reel post support 22'" fixed to the plate 22"" of the support 22. The sub cartridge 24 has an upper and a lower panel 25 and 26 and hubs 27 and 28. The hubs 27 and 28 have annular grooves 27' and 28' and the panels have circular openings 29 and 30 with serrated edges mounted in the annular grooves of the hubs to attach the panels to the hubs. A take up reel 31 and a supply reel 32 are rotatably mounted on the hubs 27 and 28 between the panels, and a reel of unused tape 33 is wound on the supply reel 32 with its outer end attached to the take up reel 31. The upper and lower panels 25 and 26 have elongated slots extending between the take up reel and the supply reel with felts strips 36 and 36' fixed therein. The lower strip in the lower panel acts to frictionally engage the edge 37 of the supply reel of tape 33 along its entire radius from its innermost edges 37' to its outermost edge 37", as well as engage the edge of any tape wound on the take up reel. The lower strip 36' acts as a frictional drag upon the supply reel of the tape as it leaves the supply reel, so that the tape is taut as it passes the print wheel, between the supply reel and take up reel, for satisfactory printing by means of the tape.

Latch mechanism 40 is provided in the cartridge housing 20' to lock the slidable support 22 in a position, so that the sub cartridge 24, if on the support 22, its take up reel and any tape on the take up reel will be sufficiently spaced far enough away from the drive 21 to remove the sub cartridge from the support and housing, without interference by the drive member.

A release member 41 is provided on the housing to release the lock after another sub cartridge has been replaced.

Figure 11A:
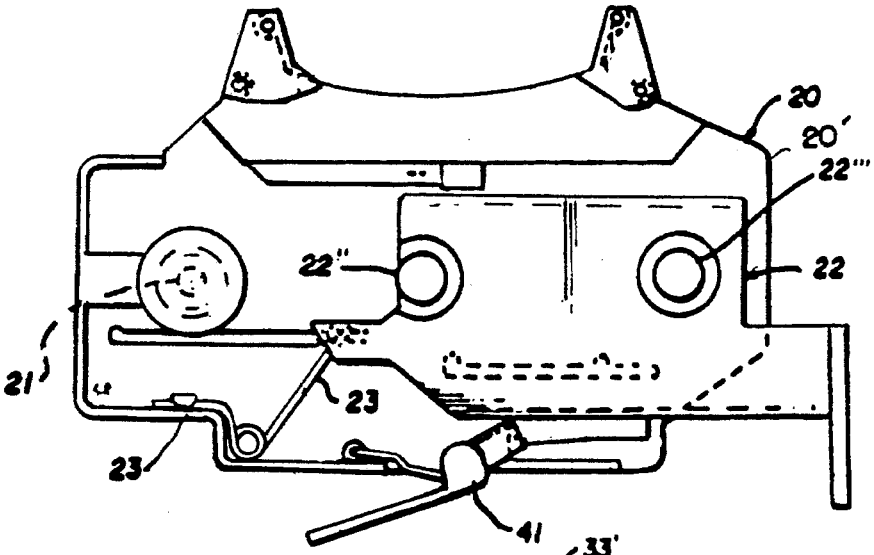
FIG. 11(*a*) is a top plan view of the first form of the invention, after the sliding plate has been manually slid to the right by the handle to its latched position for receiving the sub cartridge.
Figure 11B:
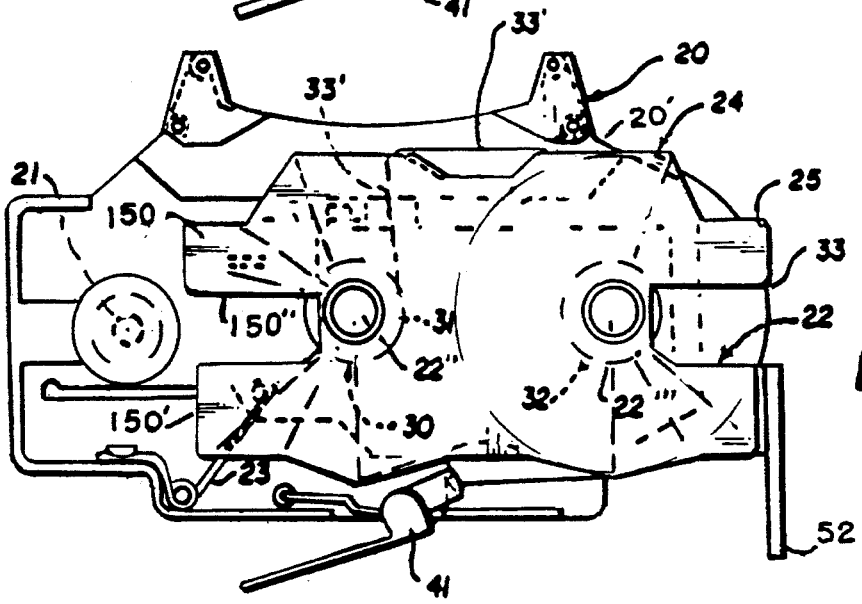
Figure 11C:
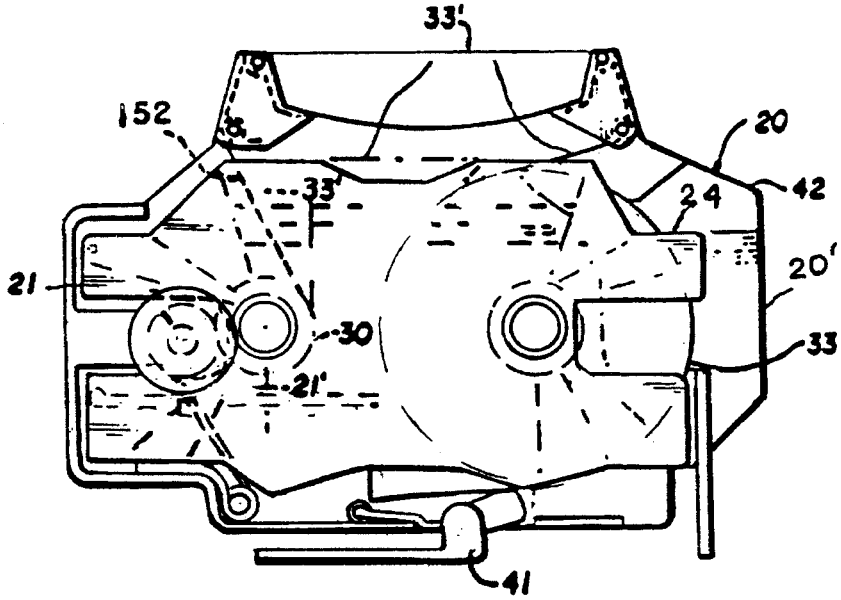

The release member 41 is a lever arm or handle with a column 41' fixed thereto. A pin 44 is fixed to the base 46 of the cartridge housing and extends upward and the column 41' of the lever is rotatably mounted thereon. A toe 53 is fixed to the lower end of the column 41' so that pushing the lever 41, by the operator, pivots the lever about the axis of the pin and rotates the column on the pin which rotates the toe 53 clockwise when viewed from FIG. 1. A spring 54 is mounted over the column 41' with one end attached to the wall 70 of the housing and its other end attached to the toe 53. The spring 54 urges the toe counterclockwise, when viewed from FIG. 1, against the side 55" of the support 22 as it slides along the side 55", except when the sliding support 22 has been pulled by the handle 52 to its extreme right position in the housing shown in FIG. 11. In which case, the toe will be aligned with the notched leading edge 55' and will be caused by the spring 54 to pivot into its locked position in front of the leading edge 55' of the support, as shown in FIG. 11. The sliding support, if allowed to move back to the left by the release of the handle by the operator, will engage the toe with its leading edge 55' and be prevented from further movement to the left. When the toe has been pivoted to its locked position in front of the edge 55', pin 44' is engaged by the projecting rod 44'" fixed on the toe which prevents further counterclockwise movement of the toe; and it is held against the pin by the urging of the spring 54 and locks the toe and support from movement left toward the drive 21.

The drive member 21 has a spoke member 21' fixed to its shaft and a disc member 21'" is also fixed to the shaft 21. The lugs 74, fixed to the sliding support, extend into the slots 22' of the housing with lateral ends 74' that extend laterally over the edges of the slots to retain the support to the base of the housing, while guiding the movement of the support along the base of the housing. The spring 23 is mounted over the column 80" fixed to the base of the housing, with one end attached to the wall 70 and the other end 23" engaging the support 22 to urge it toward the drive member.

Installation of Cartridge in Typewriter

The cartridge 20, as illustrated in FIGS. 1–5, is installed in a conventional print wheel type typewriter in a conventional manner having a drive comparable with the drive of a conventional typewriter and conventional lug means 42' which engage in slots in a typewriter with a slot 42" to receive the locking member of a typewriter. The outward configuration and shape of conventional, previous existing cartridges and the position of their drive member, in relation to the cartridge, can be generally retained with the new cartridge housing, sub cartridge in the interior and their operation. For example, ample, in the form shown in FIGS. 1–5, typewriters produced by several companies are capable of accepting or using this cartridge in their machines for typing.

The print wheel of the typewriter will project immediately behind the portion or intermediate segment 33' of the tape between the supply reel 32 and take up reel 31 of the sub cartridge. The rounded corners 48 and 48' of the cartridge housing 20', at the pointed ends of the cartridge housing, will act to guide the tape from the supply reel of the sub cartridge, past the print wheel, and onto the take up,reel of the sub cartridge. A pair of posts 45 and 45' are fixed to the base 46 of the cartridge housing and have a pair of rollers 47 and 47' rotatably mounted to these posts. The rollers have upper and lower flanges 47" fixed thereto, with the rollers and flanges acting to guide the tape past the print wheel. While the corners have a projecting upper lip portion 62', which determines the final height of the tape relative to the print wheel, the rollers 47 and 47' also help to maintain that height and assist in guiding the tape onto the take up reel properly and evenly.

An L shaped flange 49 has one leg 49' which extends over the top of roller 47 and a similar flange 49 has one end attached to the base of the housing and its other end extending over the top of the roller 47'. The other leg of the flanges act to keep the rollers mounted in place on the posts. The flanges also act to prevent the operator from placing the tape on the side of where the leg 50 of the flange is located.

Typing Operation

In the typing operation, the cartridge, with a new sub cartridge of unused tape, will at the beginning of the typing be in a position as illustrated in FIG. 1, after being installed in the typewriter. The drive member 21 of the housing has a bore 21" in its bottom, with radial inner flanges that engage a pointed flange drive in the typewriter in complementary relation. The drive member 21 of the housing has a spoke 21' that engages the outermost layer of tape on the take up reel of the sub cartridge and drives the tape onto the take up reel. As more and more tape is wound onto the take up reel of the sub cartridge; the sliding support 22 of the housing and the sub cartridge 24 move gradually from left to right, from FIG. 11(*c*) to FIG. 11(*d*), to provide room for the tape; while the spring 23 acts to urge the support 22 of the housing and the sub cartridge 24 from right to eft and thereby maintain the spoke 21' of the drive member in engagement against the outer periphery of the outermost layer of tape on the take up reel of the sub cartridge, to thereby continuously drive the tape from the supply reel to the take up reel.

The spoke drive of the housing is a conventional type of drive, with the spoke engaging the outer periphery or outer surface of the outermost layer of tape on the take up reel to drive and advance the tape onto the take up reel from its periphery, and thereby drive the tape at a constant linear speed, past the print wheel, with each advance printing another symbol or element while also winding the tape onto the take up reel.

The felt strip 36' on the bottom panel 26 of the sub cartridge acts as a frictional drag upon the tape 33 leaving the supply reel, so as to maintain the tape taut as it passes the print wheel. This is necessary or desirable for satisfactory imprinting of the carbon on the tape onto the paper by the print wheel striking the tape at this point.

Also, the fact that the tape, when the cartridge and sub cartridge are mounted in their customary horizontal position in the typewriter, weighs down on the under felt strip 36' on the bottom panel of the sub cartridge; and it causes additional drag upon the reel of tape as it is being unwound from the supply reel and is being driven onto the take up reel off the sub cartridge.

The felt strip 36 of the top panel 25 of the sub cartridge may be close enough to engage the tape edge 37 on its top to provide some drag, if desired. However, the frictional drag by the bottom strip is intended to provide sufficient drag upon the bottom edge 37' for proper operation.

When All the Tape Has Been Transferred, by Typing, onto the Take Up Reel of the Sub Cartridge (FIG. 11(D) and a New Sub Cartridge Is to Be Installed in the Cartridge, the Cartridge Is Removed from the Typewriter and the Following Takes Place When all the tape on the supply reel of the sub cartridge has been transferred onto the take up reel, as illustrated in FIG. 11(D); and it is desired to remove the sub cartridge and replace it with a new one; the operator needs only remove the cartridge from the typewriter, grasp the handle 52 of the sliding support, and pull the handle 52 from left to right from its position shown in FIG. 11(*d*) to its position shown in FIG. 11(*a*) to thereby pull the sliding support 22 in the slots 22' and the sub cartridge thereon a short distance to the right. When the sliding support 22, with the sub cartridge thereon, reach their furthest position shown in FIG. 11(*a*); the toe 53 of the release lever 41, which is spring urged counterclockwise by spring 54 when viewed from this Figure, is released. The toe is released by the notched portion 55 of the sliding support 22 aligning with the toe 53 so that the toe is freed to pivot, under the urging of the spring 54, counterclockwise and does pivot counterclockwise to its locked position shown in FIG. 11(*a*) to automatically lock the support in its extreme right position, substantially as shown. The toe, in this position engages the pin 44' fixed to the base of the housing of the cartridge, and it prevents further counter-clockwise movement of the toe 53, thereby locking the toe. The toe hereby locks the sliding support 22 from returning back to the left, except for the short distance needed for the toe to clear the edge of the support. When engaged in its locked position, the sliding support's leading edge 55' stops the support in this position by engaging the toe, and this prevents further movement of the sliding support to the left toward the drive member, since the toe is in front of the leading edge 55' and thereby locks the sliding support from sliding to the left along the slots.

The position of the sliding support 22, when it is in its extreme right position in the cartridge housing, spaces the outermost layer of tape wound on the take up reel sufficiently far enough from the spoke 21', as illustrated in FIG. 11(*a*), even though all the tape from the supply reel is wound thereon, that the cartridge can be lifted up axially along the posts of the sliding support 22 and removed from the cartridge housing easily without danger of contacting the tape with the points of the spoke.

The spacing being provided is such that it is intended that the size of a full reel of tape would approximate the size illustrated in relation to the size and position of the spoke and components of the cartridge. Consequently, it is desirable that the size of the full reel of tape not be appreciably larger than illustrated in relation to the size and location of the cartridge housing and components of the cartridge housing, so that there is sufficient space when the support is in its extreme right position, unless of course, more space is provided in the cartridge housing.

The toe has an upper flange 53' that projects out to keep the sliding support adjacent the base 46 of the housing and in alignment with the toe horizontally; and the projecting flange has a tapered outer edge to facilitate engagement with the support. Flange 53' extends over the top of the support portion During the typing operation, as the tape is unwound from the supply reel with each advance of the drive mechanism, there is progressivley less inertial overtravel caused by the drive mechanism, As the tape is unwound from the supply reel, the weight of the tape reduces on the supply reel. Also, the lever arm torque applied reduces, since the torque Is being applied to the outermost layer and this outermost layer has an ever reducing radius causing less and less applied lever arm torque from each tape advance with the drive mechanism. Consequently, there is less and less need for drag upon the tape remaining upon the supply reel, as the unwinding continues, to prevent inertial overtravel and resulting looseness of the tape, since there is progressively less and less inertial overtravel or flywheel effect resulting as to the tape remaining on the supply reel.

Since the frictional drag by the strip 36' to prevent this overtravel is only applied to the tape layers that remain on the supply reel; as the radius of the remaining tape reduces, this drag upon the edge of the remaining tape layers progressively reduces or diminishes. This is consistent with the fact that less and less drag is needed.

Since all layers 64 of the tape, whether they are wound on the supply reel and/or take up reel, will, along their edges, frictionally rest upon the strip 36'; every layer is provided with a frictional drag to keep the tape taut as it is advanced by the drive mechanism past the print wheel onto the take up reel, for smooth, tighter winding of the tape onto the take up reel.

It has been found that when reels are free of friction substantially, the tape may unwind from the reels simply upon sudden movement of the unit carrying the reels in ordinary handling of the reels. Then, the tape must be rewound onto the reel causing additional problems in a unit having such reels such as a sub cartridge. By this light drag at all times upon both reels, unwinding upon sudden jarring of the sub cartridge or sudden movement in ordinary handling no longer takes place as readily, making it easier to handle the sub cartridge roughly without problem.

Also, with the felt strip 36' on the lower panel engaging the edge of all layers of tape on the take up reel as well as the supply reel; there is always a drag upon both reels, take up reel as well as supply reel. Consequently, neither reel is free to rotate.

FIGS. 1–16, inclusive, illustrate the first form of the invention.

The preferred form is illustrated in the first form described. However, in conventional peripheral drive cartridges, the support for the take up and supply reel varies to adjust to the change in radius in different cartridges. As an illustrative example, variations in the drive and support are illustrated in the second, third and fourth species.

#2 Cartridge Form

A second modified form of cartridge 75 and sub cartridge 76 is illustrated in FIGS. 17–23, inclusive.

In this modification, neither the take up reel 81 or supply reel 81' of the sub cartridge 76 move in relation to one another nor do they move in relation to the cartridge housing, except about their rotational axes. Rather, they stay in fixed location on the cartridge housing 75' and sub cartridge 76; and the spoke drive member 97 in the cartridge housing moves with respect to the take up reel of the sub cartridge to adjust to the change in radius.

The cartridge 75 also has a pivotally mounted cover 84. The cartridge 75 has two fixed posts 79 and 79' fixed to the back wall or bottom 75" of the cartridge housing 75'. The sub cartridge 76 is constructed in a manner similar to and operates in a manner similar to the first form of the invention, having a pair of hubs 80 and 80' for being slidably received on the posts 79 and 79' of the cartridge housing. Further, it has a take up reel 81 and supply reel 81' which are rotatably mounted on hubs 80 and 80', respectively. Further, the sub cartridge has a pair of panels 82 and 82' which have circular openings with serrated edges about the circular openings forming pointed projections that are flexible enough and of resilient material to be snapped into the annular grooves in the hubs to mount the panels in a manner similar to that of the first form.

The sub cartridge 76 also has a reel of tape 33 wound on the supply reel 81' with its outer end attached to the take up reel. The sub cartridge also has a felt frictional drag strip 86 on the bottom panel 82' and a similar felt strip 87 on the top panel 82. These extend from near the center axis of the supply reel radially outward with one strip portion near the take up reel. They engage the edge 88 of the tape wound on the supply reel and take up reel to provide a frictional drag upon the reels of tape for assisting in providing a taut winding of the tape onto the take up reel of the sub cartridge, as in the first form of the invention.

The cartridge housing 75' has a drive shaft 89 with radial grooves in its lower end to engage the conventional drive of a typewriter of the print wheel type, for example. The drive shaft is rotated by the drive of the typewriter. The drive shaft 89 is rotatably mounted in a bore 90 in the base 75" of the cartridge housing 75', as in the first form of the invention. A pivoting spoke drive bracket or arm 91 has one end rotatably mounted to the shaft 89 and a pulley 92 is fixed to the shaft 89, on top of the bracket 91. An L shaped support bracket 94 has one end 94' fixed to the base 75" of the cartridge housing 75' and its other end 94" has a bore to rotatably support the upper end of the shaft 89 in the cartridge housing.

The pivoting spoke drive bracket or arm 91 has a second shaft 95 rotatably mounted in a bore in the bracket or arm, at its outer end. A pulley 96 is fixed to the shaft 95. A pulley drive belt 96' connects the pulley 92 to the pulley 96 in driving relation. A spoke member 97 is fixed to the shaft 95. A spring 93 has one end attached to the bracket or arm 91 and its other end fixed against the wall of the cartridge housing. The spring urges the bracket or arm to pivot about the shaft 89, counterclockwise when viewed from FIG. 17. It causes the spoke member at the outer end of the arm to engage against the outer peripheral edge of the tape 33 on the take up reel. The typewriter, when typing with a print wheel engaging the tape portion between the reels to print from the tape onto paper in the typewriter for example, will rotate the drive shaft 89 which rotates the shaft 95, which rotates the spoke member 97, which drives the tape 33 onto the take up reel of the sub cartridge.

Also, in this second specie, the arm 91 has a projecting flange 91' fixed to its outer end which projects under and slides along the annular flat ridge 91", which ridge is fixed to the base 75" of the cartridge housing. The sliding engagement of the annular ridge with the projecting flange acts to keep the rotating spoke member 97 of the arm 91 in parallel alignment with the base 75" of the cartridge housing, as it pivots away, by the tape being wound onto the take up reel gradually urging the drive member away as the outer diameter of the tape increases.

Figures 17, 18, 19, 20, 21, 22, 23:
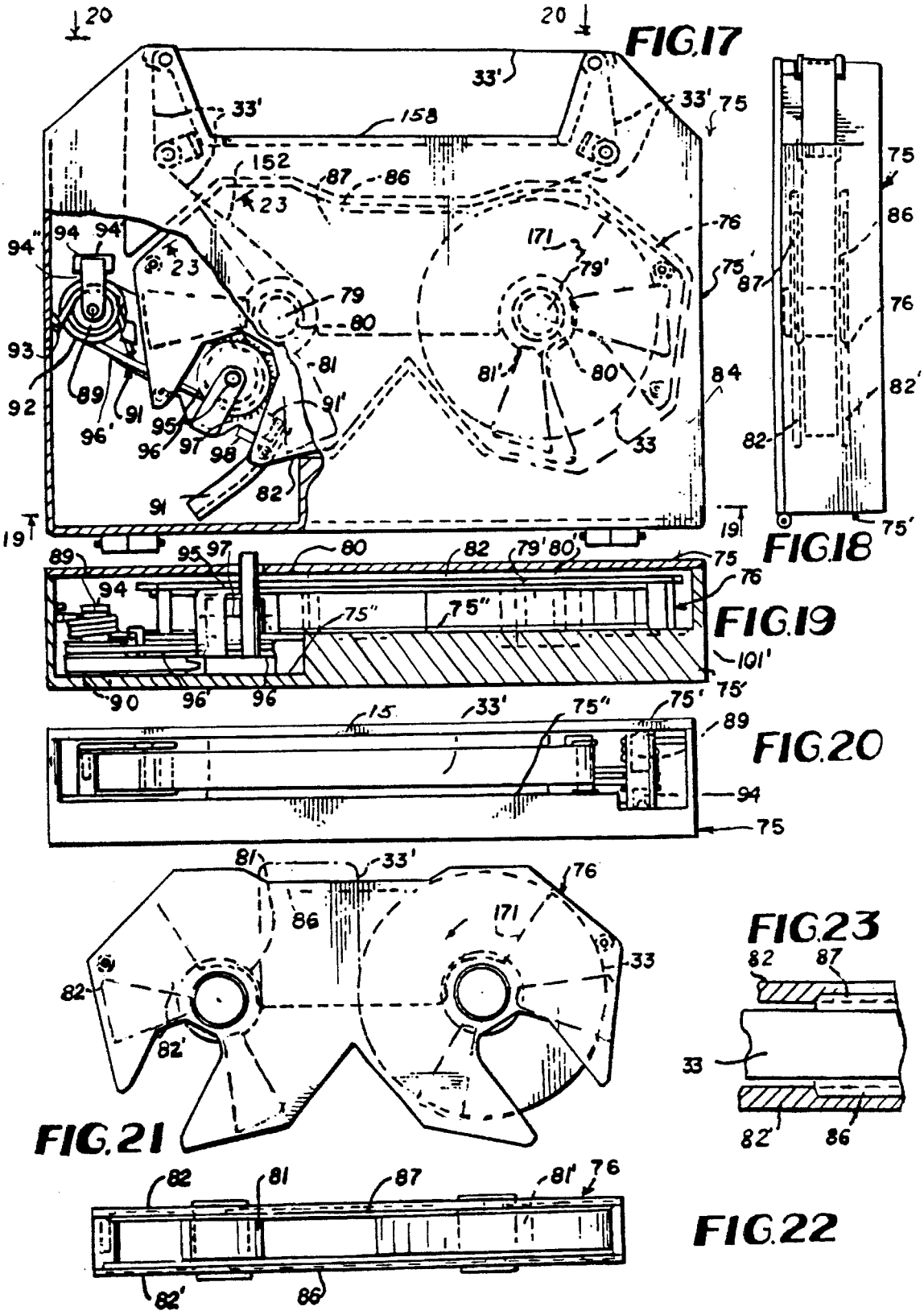
FIG. 17 is a top plan view of the second form of cartridge or container with the sub cartridge of the second form mounted therein.
FIG. 18 is a right side view of the second form of cartridge and sub cartridge.
FIG. 19 is a cross-sectional view taken along line 19—19 of FIG. 17.
FIG. 20 is a view taken along line 20—20 of FIG. 17.
FIG. 21 is a front view of the second form of sub cartridge.
FIG. 22 is a top plan view of the second form of sub cartridge.
FIG. 23 is a cross-sectional view taken along line 23—23 of FIG. 17.
Figure 26:
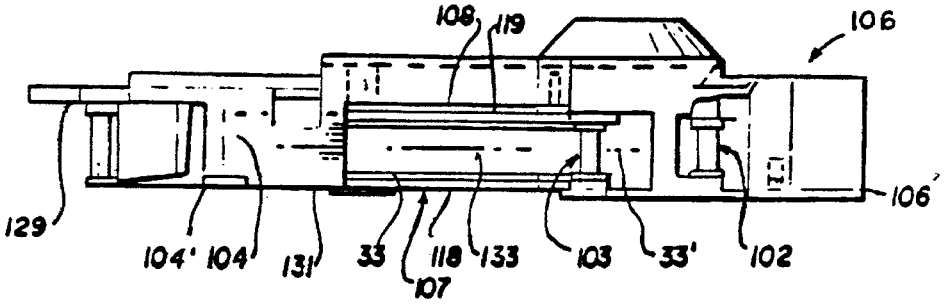
FIG. 26 is a front view of the third form of cartridge and sub cartridge.
Figure 24:
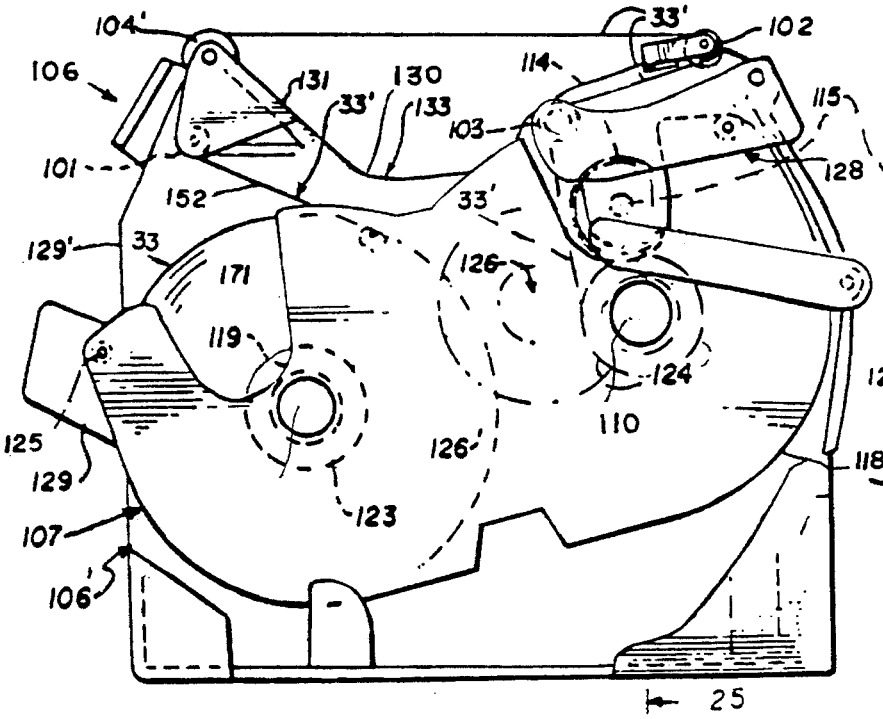
FIG. 24 is a top plan view of the third form of cartridge with the sub cartridge mounted therein.
Figure 27:
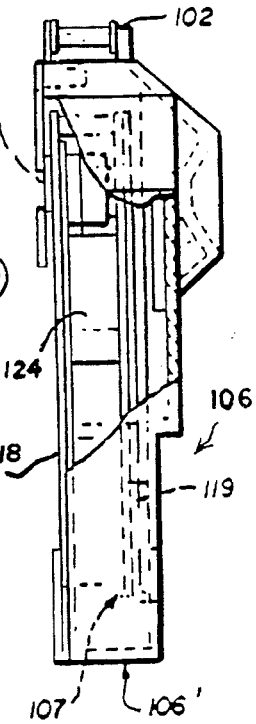
FIG. 27 is a right side elevational view of the third form of cartridge and sub cartridge.
Figure 25:
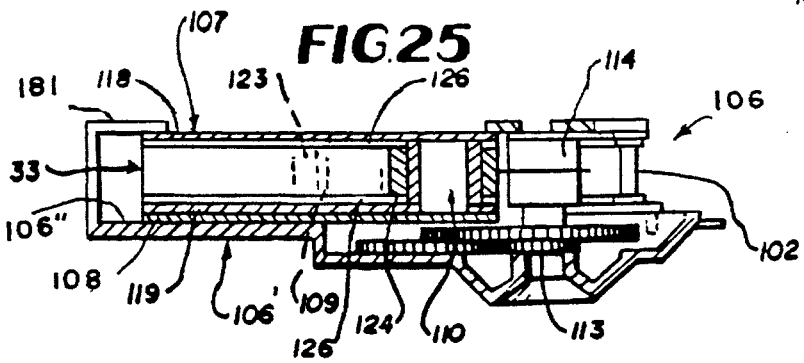
FIG. 25 is a cross-sectional view taken along line 25—25 of FIG. 24.
Figure 28A:
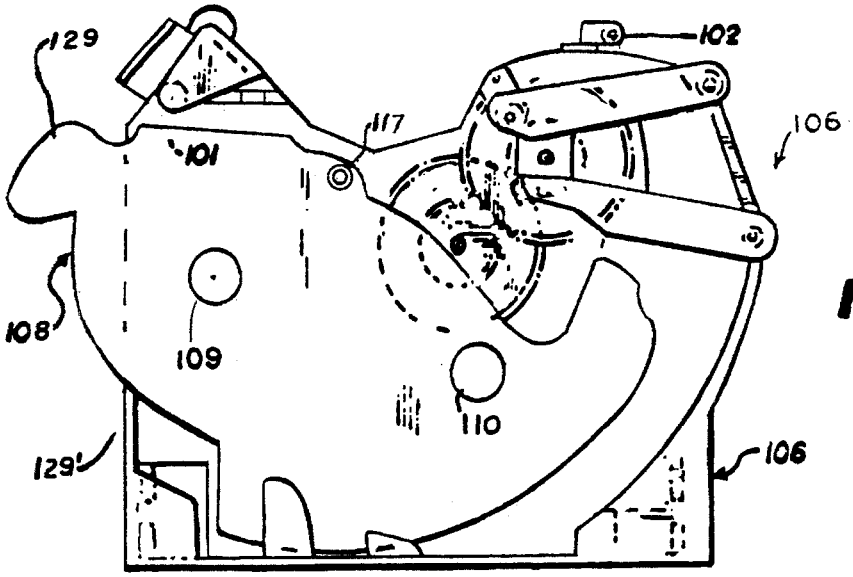
FIG. 28(*a*) is a top plan view of the third form of cartridge with the pivoted support plate pivoted to the left, ready to receive the sub-cartridge.
Figure 28B:
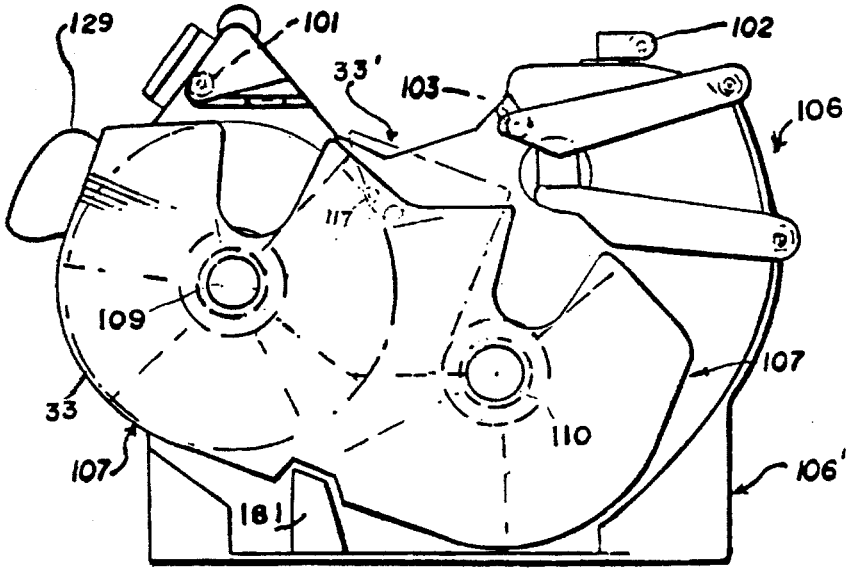
Figure 28C:
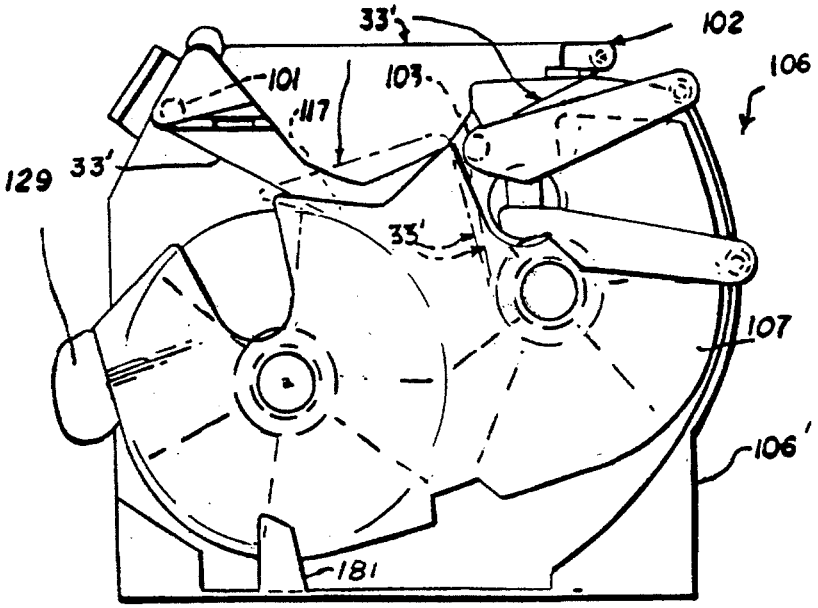
Figures 33, 34, 35, 36, 37, 38A, 38B:
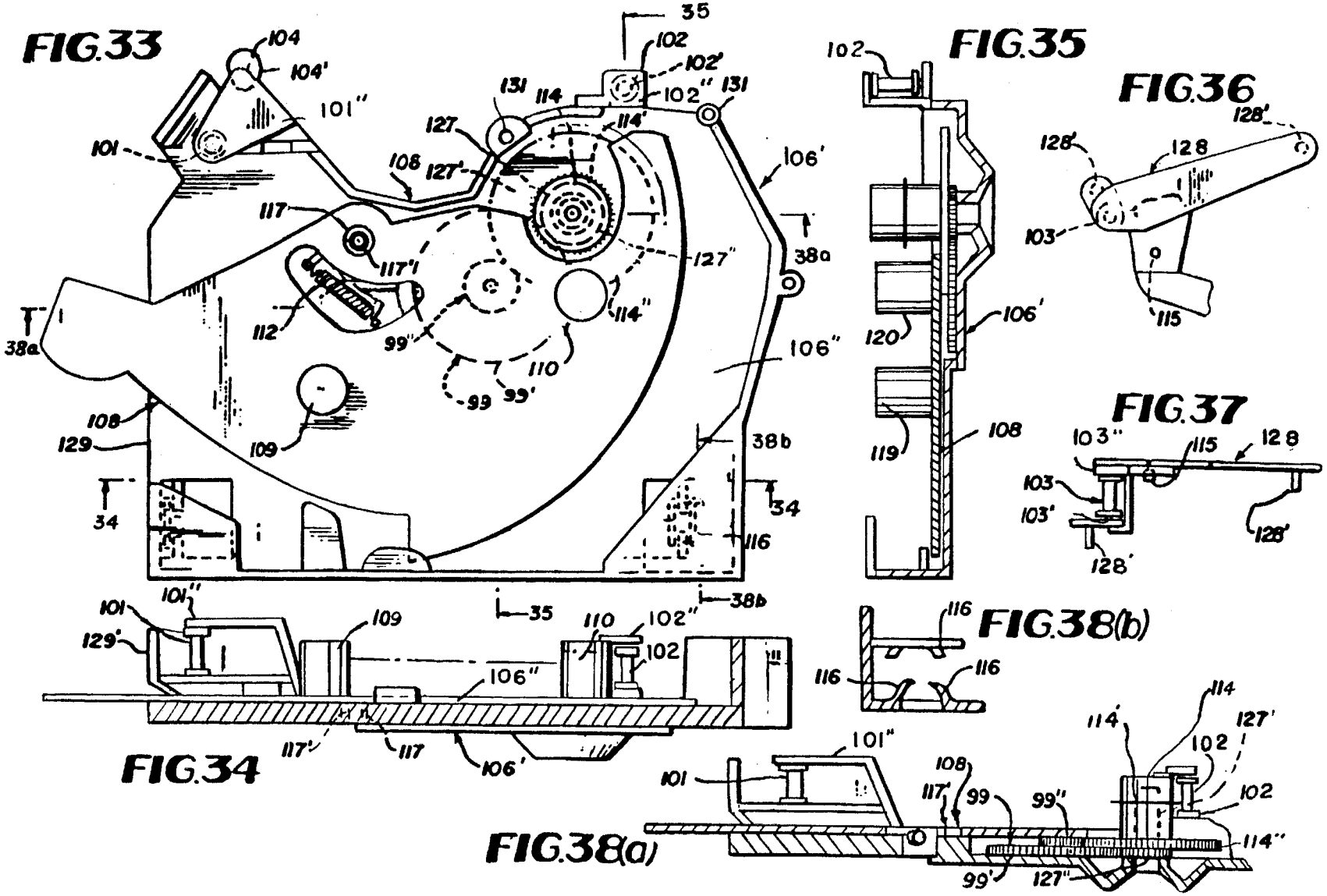
FIG. 33 is an enlarged top plan view of the cartridge of the third form of the invention.
FIG. 34 is a cross-sectional view taken along line 34—34 of FIG. 33.
FIG. 35 is a cross-sectional view taken along line 35—35 of FIG. 33.
FIG. 36 is a top plan view of the drive cover.
FIG. 37 is a top plan view of the drive cover of the cartridge.

A handle 98 is provided that is fixed to the bracket 91 to enable the operator to grasp it, and pivot it about the bracket clockwise to the left when viewed from FIG. 17 sufficiently, so that the spoke member 97 of the drive member is spaced away from the take up reel and any tape on the take up reel. This enables the sub container or cartridge 75 to be slidably removed from the posts of the cartridge housing, when the cover 84 is pivoted open, and removed from the cartridge housing and replaced with a new sub cartridge or reversed.

Latching means may be provided in the cartridge housing to latch the bracket in its extreme left position while removing the sub container or sub cartridge from the cartridge housing.

#3 Cartridge

A third modification is illustrated in FIGS. 24–38, inclusive. In this modification, the cartridge 106 has a cartridge housing 106' and a sub cartridge or container 107 with a pivotal support plate 108 in the cartridge housing 106'. The pivotal support plate 108 has a supply reel post 109 and a take up reel post 110 mounted thereon. The pivotal support or pivotal plate 108 has a sleeve 111 which is pivotally mounted on a pin 111" which pin 111" is fixed to the base 106' of the cartridge housing.

The third modification is similar to the first modification, in that both the take up reel and supply reel posts 109 and 110 are mounted on a pivotal or movable support, except that in the first form of the invention, the movable support 22 moves in a straight line whereas in the third form, the movable support pivots about a circle. In this form, a spring 112 urges the pivotal support 108 counterclockwise against the drive member 114.

The sub cartridge or container 107 has an upper and lower panel 118 and 119, with serrated openings 120 in the upper panel 118 and with the edges of the openings mounted in annular grooves 121 and 121' in the hubs 122 and 122'. The hubs, at their lower ends, are fixed to the lower panel 119, which construction is also similar to the first form. A supply reel 123 and take up reel 124 are mounted on the hubs with a reel of tape 33 wound on the supply reel with the outer end of the tape attached to the take up reel 124. A felt frictional strip 126 extends along each of the panels 118 and 119 between the center axes of the supply and take up reel for drag and tautness. The sub cartridge 107 is slidably mounted on the posts 109 and 110 of the pivotal support 108 in the cartridge housing.

The drive member 114 has its bottom mounted in a bore of the cartridge housing 106' and has radial grooves in the bottom for driving engagement with a conventional typewriter for driving the tape past the print wheel of a typewriter for typing and then onto the take up reel of the sub cartridge, when the cartridge 106 is installed in a typewriter. The cartridge has three rollers 101,102,103 rotatably mounted on pins 101',102', and 103' fixed to the cartridge housing 106'. The roller 101 is positioned to align and guide the tape from the supply reel down around the guide post 104, and across where the print wheel would be.

The roller 102 is positioned to align and guide the tape back and upward around roller 103. From roller 103 the tape travels back onto the take up reel 124.

The drive member 114 of the housing has an outer radial spoke like surface 114' for engaging against the tape 33 at its outer periphery on the take up reel, for frictionally driving the tape onto the take up reel. A drive cover bracket or plate 128 has a pair of pins 128' fixed at spaced locations on the bracket or plate which fit into bores 131 in columns in the base 1o6' of the cartridge housing 106". The bracket 128 has a pin 115 to rotatably receive the bore like upper end of the drive member 114 to rotably support the upper end of the drive member, when the bracket 128 has been mounted to the base of the housing. The bracket 128 has a pin 103' to rotatably support the roller 103 thereon, with a lip portion 103" fixed to the bracket and extending over the top of the roller 103 to hold it in place for rotation on the pin. The tape 33 is wound on the supply reel 123 and its outer end extends to the take up reel and is mounted thereon.

The pivotal plate 108 of the housing has a handle 129 fixed to one edge of the plate, which handle extends out through an opening 129' in the side of the cartridge housing 106'. The handle is used to pivot the plate 108 to its extreme left position illustrated in FIG. 28(*a*), for attachment and detachment of the sub cartridge to the sliding pivotal support of the cartridge housing.

The upper panel of the sub cartridge or container has a pair of pins 125 fixed to its outer ends, which slidably fit into sleeves fixed to the lower panel to frictionally retain the pins in the sleeves and thereby fix the upper and lower panels together in spaced relation. If the sub cartridge is made non reversable, the lower felt strip may have an enlarged felt area adjacent the supply reel axis. The lower felt strip provides a constant drag upon the supply reel and supply ribbon, as it unwinds from the supply reel onto the take up reel to keep the tape segment taut.

When it is desired to remove the sub cartridge or sub container, the operator will grasp the handle 129, which is fixed to the plate 108 and pivot the plate 108 of the cartridge housing further clockwise to its extreme left position with the sub cartridge thereon, until the outermost layer of tape on the take up reel is pivoted away from the spoke surface of the drive member, so that the sub cartridge can be easily removed from the posts of the plate of the housing without the spoke surface engaging the tape, and the tape segment 33' slid off the rollers 101 and 102 and guide posts, while the operator holds and maintains the plate 108 in its extreme left position manually.

While the operator holds the plate 108 of the cartridge housing in its extreme left position, a new sub cartridge with a full supply reel of new ribbon may be mounted on the sliding pivoting support 108; or the sub cartridge may be reversed if only half of the tape has been typed on, and the other half used to type on while driving the tape back to the supply reel. Once a new sub cartridge is attached or a sub cartridge is reversed, the handle 129 of the cartridge housing will be released to release the plate 108. The plate may now pivot back, with the sub cartridge, to engage the drive again and tightened, and reinstalled in a typewriter for typing repeating the sequence again.

The felt strips are recessed in the upper and lower panels 118 and 119, so that they project inwardly only a slight or small portion of their thickness for contact with the ribbon and in relation to the inner surfaces of the upper and lower panels adjacent the strips. The felt strips will project inwardly only enough to place the desired amount of drag upon the edge of the ribbon to keep it taut and prevent accidental unwinding in ordinary use.

The rollers 101 and 102 of the cartridge housing, which are rotatably mounted on pins 101' and 102' fixed to the cartridge housing base 106", have L shaped flanges 101" and 102" also fixed to the base 106" to hold the rollers in place on the pins for rotation.

Operation

The operation of the third form of the invention is as follows:

The sub cartridge 107 is mounted onto the cartridge housing 106', by the operator manually pivoting the plate 108 of the housing clockwise to its position shown in FIG. 28(*a*); by, for example, placing his left index finger against the front 130 of the cartridge housing, with the palm of his hand beneath the cartridge housing; placing his left thumb against the rear edge of the handle 129 of the plate 108, and pivoting the handle thereby the plate 108 clockwise toward the left index finger, to its position shown in FIG. 28(*a*). Then holding the plate in this position, the sub cartridge 107 is attached to the plate 108 of the cartridge housing, by sliding the sub cartridge hubs onto the posts 109 and 110, as illustrated in FIG. 28(*b*).

Once the sub cartridge 107 has been attached, the operator will manually release the handle 129. This thereby releases the plate 108 and its spring 112 will urge the plate back, causing the plate 108 to pivot counter clockwise back until the take up reel 124 of the sub cartridge, mounted thereon, engages the drive 114 of the cartridge housing as illustrated in FIG. 28(*c*). Since the outer end of the ribbon 33' is permanently attached to the take up reel, the spoke member 114' peripherally engages the tape on the take up reel to drive the same.

Once the take up reel has engaged the spoke of the drive member of the housing, the tape or ribbon segment or section 33' can easily be attached to or looped about the rollers. This is done by drawing the ribbon section or segment 33' out through the opening in the front of the cartridge housing, which lengthens the segment between the reels. The lengthening comes only from the unwinding of the supply reel, as the drive engagement against the take up reel prevents any rotation of the take up reel, by the drawing of the tape segment outward between the reels. Once the tape segment has been sufficiently enlarged, the segment 33' can be easily attached or looped about rollers 101 and 102, and about post 104 and beneath overhanging lip 104', which acts to align the segment about roller 103, thereby placing the tape or ribbon in its loose operative position.

The tape segment 33' having been loosely mounted to the rollers, its length or segment between the reels will be shortened by manually winding the supply reel in a clockwise direction, when viewed from FIG. 28(*c*). The ribbon will be shortened until the tape segment 33' between the reels is taut about the three rollers with the frictional drag of the felt strip of the sub cartridge holding the ribbon taut, once it is wound in this fashion.

The tape segment 33' having been operatively positioned taut, as shown in FIG. 28(*c*), the cartridge 106 may now be operatively attached to a typewriter in a conventional manner by mounting the conventional lugs 116, in the right and left corners of the cartridge housing 106', to the slotted plates of the typewriter and engaging the drive slotted bottom portion with the conventional slotted post drive of the typewriter, with the ribbon between the reels placed conventionally behind the print wheel, so that the typing can begin with the typewriter advancing the take up reel, as the print wheel types on the ribbon as it travels past.

As the drive member 114 of the cartridge housing drives the tape 33 onto the take up reel 124, each added tape layer increases the outer diameter of the tape thereon and through the peripheral engagement of the drive member with the outermost layer, the added tape layers move the take up reel and the rest of the sub cartridge and plate 108 clockwise about the pivot point of pin 111', gradually away from the drive member of the housing. The spoke surface of the drive member, meanwhile continues to engage and drive the tape onto the take up reel, while the spring 112 continously maintains the reel at its periphery engaged against the spoke member.

When substantially all the tape has been driven onto the take up reel, the sub cartridge or container 107 and the pivotal support will have pivoted in the housing to the position illustrated in FIG. 28(*d*).

The container housing 106' has an opening 133 in the front wall 130' of the container or cartridge housing to provide access to the ribbon portion 33' between the supply reel and take up reel. The opening in the cartridge makes it easier to draw out the ribbon portion 33' between the reels to enlarge the portion between the reels by unwinding it from the supply reel to make it easier to attach or loop this portion about the rollers 101 and 102 and attaching or looping the tape about these two rollers normally automatically places the tape about roller 103 and posts, as seen in FIG. 28(*c*).

This opening enables the ribbon portion 33' not only to be attached after the sub cartridge 107 has been attached to the sliding pivot support 108 of the cartridge housing, but also after the support handle has been released by the operator, releasing the sliding pivot support so that its spring urges it, with the sub cartridge thereon, pivoted back so that the take up reel of the sub cartridge has engaged against the drive member. This engagement locks the take up reel to the action of the drive member, so that the take up reel will not accidentally unwind while the tape segment is drawn out through the opening and attached.

While latching means may be provided in the cartridge to latch the pivotal support 108 in its extreme left position for this form of the invention, it is not a necessity; as the handle can be easily held by one hand to keep the plate 108 in its extreme left location while loading and unloading a sub cartridge into and from the cartridge.

The drive for the cartridge housing is conventional. It has a drive member 114, which has a large radial gear 114" fixed thereto and has a hollow center. A small rotary gear 127 with an upper column 127' is rotatably mounted in the bottom hollow center of the drive member 114. The small gear 127 has a small tooth gear 127" fixed thereto and a flanged opening 127'" in its bottom to receive and engage the drive of a typewriter. A rotary reduction gear 99 has a large toothed gear 99' and a small toothed gear 99" that are fixed together and has a center opening to rotatably mount the gear on a pin 99'" fixed to the base 106" of the cartridge housing 106'. The typewriter drives the gear 127 by engaging the bottom, and the gear 127 rotates freely of drive member 114 and its gear 127" engages and drives the large gear 99' which rotates the small gear fixed thereto. The small gear 99" engages the large gear 114" of the drive 114, to thereby rotate the spoke member 114' fixed to the drive member, at a reduced speed for the multi strike operation. This gear arrangement provides a gear reduction drive. When correctable ribbon is used in the sub cartridge, the reduction gear 99 would be removed and the rotary gear 127 would be fixed to the drive member 114, so that there would be a direct drive from the rotation of gear 127 to the rotation of drive 114. When a direct drive is employed, the large gear 114" on the drive member 114 can be eliminated.

The sleeve 117 of the pivoting plate of the housing will have an annular groove cooperating with an annular ridge on the pin 127', which pin is fixed to the base 106" of the housing. The annular groove locks the plate against axial movement, up and down along its axis, while allowing the plate to pivot about its axis for the operation, to assure the plate assumes a constant height above the base of the cartridge housing.

#4 Cartridge Form

The fourth modification of the typewriter cartridge is illustrated in FIGS. 39–45, inclusive, and has a cartridge 134 and sub cartridge 135. In this form of cartridge, as in some conventional cartridges, only the take up reel moves in the cartridge housing 134' to compensate for the increasing outer diameter of the tape on the take up reel, as the tape is wound onto the take up reel. The cartridge housing 134' has a pivoting plate 137 which has a collar 138 fixed to the plate and which is pivotally mounted on a pin fixed to the base 136 of the cartridge housing. A take up reel post 139 is fixed to the plate 137, so as to pivot with the plate about the axis of the pin. The cartridge housing 134' has a supply reel post 140 which is fixed to the cartridge housing at the base 136 of the cartridge housing.

Since only the take up reel 142' moves or pivots forward and rearward, toward and away from the drive member 23 of the cartridge housing, while the supply reel post remains stationary; the sub cartridge is provided with a center pivot 147. This enables the panels 143' and 143" of one panel 143 of the sub cartridge having a take up reel hub 142 and take up reel 142' to pivot with the pivoting plate, while the supply reel hub 141 and supply reel 141' of the sub cartridge mounted on post 140 pivots axially about this post of the cartridge housing. The supply reel hub and supply reel are mounted between the panels 144' and 144" of the other portion 144 of the sub cartridge, and these portions are pivotally connected together at pivot point 147 by a pivoting column 147' fixed to one portion and pivoting in bores in the other portion. A reel of typewriter ribbon 33 is wound on the supply reel 141'. Its outer end extends to and is connected to the take up reel 142', and when the sub cartridge is mounted in the cartridge housing, it extends about the rollers 136" rotatably mounted on the cartridge housing to guide the tape while between the reels.

Each panel portion has openings in their surfaces for mounting the take up reel hub and supply hub thereto, and each panel portion has a felt strip 145 which acts as a frictional drag upon the tape wound on the supply reel and take up reel in the same manner as in other species.

The panels of the portions 143 and 144 of the sub cartridge are constructed with the intermediate connection, so that the panels can adjust for the change in the spacing distance of the take up reel and supply reel and their posts, as the tape is wound onto the take up reel of the sub cartridge by the rotating drive member 23. When the cartridge is installed in a typewriter, the spoke engages the tape on the take up reel to wind the tape onto the take up reel as the tape travels. The tape travels from the supply reel past one roller 136", about one guide post to the other guide post and about the roller 136" onto the take up reel, with the printing wheel typing on the tape as it passes between the guide posts, and with the take up reel pivoting support 137 pivoting away from the spoke of the drive member to compensate for the increase in the diameter of the tape on the take up reel as it winds thereon. A spring 138'" urges the support 137 toward the drive member 23 and thereby maintains the take up reel 142" and any tape thereon in engagement with the spoke of the drive member.

The cover 146, which is pivotally mounted to the case 146' by hinges 148, can be pivoted open, and the sub cartridge or sub container 135 can be removed from the post 139 of the pivoting support 137 and from the fixed post 140 on the cartridge case. The intermediate portion 33' of the tape 33 can be looped or encircled about the spaced guide posts and spaced rollers while the ends of the ribbon remain attached to the reels in the sub cartridge as in the other forms of the invention. An opening 149 between the spaced guides may also be provided to facilitate the drawing out of the intermediate portion and looping it or attaching it about the guides and rollers.

A used sub cartridge may be removed by the operator grasping the handle 137' and pivoting the support and the one end of the sub cartridge away from the spoke member so that the sub cartridge can be removed from the posts 139 and 140.

After the used sub cartridge has been removed and a new sub cartridge mounted on the posts, the operator may release the handle 137', so that the support and take up reel of the sub cartridge can pivot back into driving engagement against the drive member 23 spoke and the cartridge can be reinstalled in a typewriter for use in printing by driving a new tape from the supply reel past the printing means and onto the take up reel as before.

Latching means may be provided to lock the support 137 away from the spoke member, with means to release the latching means.

This continuation in part application is adding to my earlier patent application the following:

With the immediate foregoing features in mind, the felt frictional drag member may be constructed, as previously described, with the leading and trailing edges extending at least nearly radial, and the leading edge at least nearly perpendicular for more even winding onto the take up reel, when the felt frictional member is in the upper panel and not serving as a frictional drag or needed as such.

It is when the sub cartridge is being constructed so as to be reversable, so that the two felt frictional areas are being provided on the sub cartridge, one on the lower panel and one on the upper panel, that it is particularly desirable that both felt areas be constructed radially and perpendicularly, as described. This results in the felt frictional areas further away from the center axis being at least as large or larger than near the center axis. This is desirable because the upper felt member influences the evenness of the winding, even though when it is positioned as the upper felt member it is not needed to serve as a drag, but only serves as a drag upon the reverse travel of the ribbon when it will be on the bottom position. The felt member, in projecting, nevertheless influences the height of the winding and thereby influences the evenness of the winding of the tape onto the take up reel.

Further, it is not necessary that the frictional area be kept to a minimum, and if it serves another purpose or need in doing so such as just described, namely, the need for more even winding; the areas, thus, further out along the radius may be just as large or significantly larger than near the center axis of the supply reel, as illustrated, without interferring with the drag operation.

This construction, just described, is found desirable as it has been found that if the projecting felt member initially receiving the tape from the supply reel, as the tape makes its first or initial winding, has some of its felt leading edge with a projecting rise or depth at a later arcuate point or degree than the rest of its leading edge for the initial contact with the tape; it causes unevenness in the height of the initial winding at one location with respect to another location along the radius of the take up reel of tape. A later projecting rise, for example, will not cause the tape to wind as high as an earlier projecting rise. Thus, it has been found that if some of the projecting rise or depth of the leading edge of the felt is sufficiently later than the rest of the projecting leading edge of felt, so as to be significantly less than perpendicular or so as to be at a later arcuate point; it does not change the height of the tape's initial wound position as much as an earlier projecting leading edge or depth. Thus, the tape will not be up as high on the wound reel; making it uneven, even though the height or depth of the projecting edge, with respect to the panel inner surface, is the same on the earlier projecting rise or depth as the later projecting rise or depth.

Also, while it may be desirable to have the felt frictional areas relatively wider near the center axis of the supply reel, than further away radially, in some instances, as more frictional drag is needed upon the supply reel edges as the wound reel becomes smaller from unwinding per radial increment; it isn't necessary the inner felt areas be greater per radial increment than the outer radius felt frictional area. So long as the inner felt frictional area is adequate to provide the necessary drag upon a smaller reel of tape, and the outer felt frictional area provides adequate drag upon the reel of tape for the operation; it may be equal or even greater in area along the outer radius than the inner radius in area, and in effect, provide more than adequate drag. This is true so long as it is not so large as to place too much drag upon the tape mechanism and tape so as to make it inoperative or under too much strain.

It has been found that an outer felt frictional area that is equal to an adequate radius or even significantly larger, as illustrated, does not place too much drag upon the tape to make it inoperative.

If, for example, the felt member is widened more along the inner radius, significantly, than the outer radius when the felt member is in the upper panel portion; it will press down the tape being wound more at the widened area or areas than the rest of the tape being wound along the outer radii, causing a dip in the height of the ribbon or tape being wound along the inner radius in relation to the ribbon or tape being wound later at the outer radius. This, thereby causes unevenness in the height of the windings at the inner radius with respect ot the outer radius.

Also, if the added felt areas have their leading edges as well as their trailing edges extending radially, or at least near radiially outward, so that the tape engages and disengages the felt drag area at the same arcuate point throughout the entire winding of the tape from the inner to the outer radius; it appears that the tape is wound more evenly in height throughout the entire winding from the innermost to the outermost winding onto the take up reel.

Also, it may be desirable to have the felt area extend arcuately about the axis of the take up reel, either continously or at intervals, far enough to provide an arcuate support for the tape; so that the tape can initially make enough of an arcuate wrap around the next inner layer to enable the tape to frictionally adhere to the next inner layer at its felt supported height. This also assists in providing a narrow space between the edges of the tape and the inner surfaces of the upper and lower panels for less binding with the panels.

Further, the strips project inwardly only a small amount necessary to obtain the desired drag. The projection is kept to a minimum relative to the panel inner surface to prevent uneven winding and/or minimize the tilting of the reel or tape at an angle.

Also, the take up reel and supply reel are supported at least about most of the 360 degrees about their rotational axes by a hard surface or at least at sufficient intervals about the 360 degrees are supported by a hard surface. If the reels are entirely supported by felt, they might be subjected to axial compression into the felt. Also, the hard surface about most of the arc minimizes axial tilting of the reels.

Further, the felt strips project inwardly along the top and bottom panels with the felt strips directly above and below one another, particularly where their perpendicular leading and trailing edges are located. This is so that when the tape is fed onto the take up reel for the first winding, the projection of the felt will tend to keep the tape from winding too close to either the upper or lower panels, and otherwise possibly binding with one of the panels because of winding too close to it. The felt members will determine the location of the tape relative to its position between the two panels. Assuming the space between the felt members approximates the width or height of the tape, the tape will tend to wind with its upper and lower edges adjacent the upper and lower inner felt edges; and since the inner panel surfaces will be spaced outward further than the felt surfaces, this enables the tape to be spaced slightly further away from the panel surfaces at their upper and lower edges to prevent the aforementioned binding.

The felt members have generally radial outer edges on the panels most of the species.

Additional radial felt strip 36" extend radially on the outer flanges of each panel opposite the inner center felt member 36 may be added; such as long the legs 150 of the panels 25 and 26 of the sub cartridge to provide balance to the felt support of the tape along the sides of the rotational axes of the reels of tape opposite the inner positioned felt members. Additional felt strips 126" are provided along the flanges of the third specie, if desired.

In the first specie of the invention, the sliding support may be modified.

The sliding support 22 may be mounted in a sliding guideway 49, along its one lateral edge, by a flange 49" fixed to the support 22 and engaging in and sliding along the slot 49 in the base 46' of the cartridge housing. The action of the slot and guideway upon the sliding support keeps the support sliding even and in close proximity to the base, so as to be parallel with the base constantly from one end of its operative sliding action to the other. This results in more even winding of the tape onto the take up reel of the sub cartridge. The other side 55 of the support 22 is kept even and in close parallel proximity to the base 46' of the cartridge housing by the lip 53' of the latch lever 40 engaging the top of the edge 55 of the sliding support as the support moves along.

In the first form of the invention, a change is made to the front edges 151 of the cartridge or container to provide a guide wall 151' extending between the spaced rollers 47 and 47' of the cartridge. The wall has a smooth upper surface for the tape segment 33', between the take up reel and supply reel of the sub cartridge, to slide along, when attaching and moving the tape segment toward and about the rollers by sliding the segment along the top of the wall, when operatively mounting the tape segment to the rollers and attaching the sub cartridge to the cartridge housing.

In the third form of the invention, the path 152 of the ribbon or tape 33' along the cartridge housing 106', being fed from the supply reel of the sub cartridge onto the cartridge housing and then back onto the sub cartridge take up reel, is changed from that of the earier application, so that it is believed easier to attach or loop the tape segment about the rollers 101 and 102 and against roller 103. It is believed easier to attach or loop the tape segment to the rollers 101 and 102 of the cartridge housing in operative position, when both rollers 101 and 102 are in front of the cartridge; and the tape is then fed back onto the take up reel, just after and to the left of where the drive engages the take up reel. This would be rather than having one roller at the right side of the container and the tape be fed onto the take up reel just before the drive engages the tape being fed from the right, as in the earler application as described for this form of the invention.

When the cartridge housing 106' of the third specie is viewed from FIGS. 24,28*a–d;* it is apparent the side of the cartridge housing with the intermediate ribbon portion 33' extending thereacross is further viewed as the front of the cartridge housing, as already indicated. It is further apparent from these Figs. that the rollers 101,102, and 103, already described as ribbon guides, are positioned along the left front, far right front, and near right front, respectively, of the cartridge housing 106'.

Also, it makes it easier to attach or loop the tape segment or ribbon segment about the spaced rollers and in operative position on the third roller and then manually wind the supply reel to tighten the tape segment by shortening it, as the tape is already engaged against the drive member before the tape segment is lengthened. Thus, by drawing the segment out the opening 133 in the front 131 of the cartridge housing for attachment about the rollers, as the take up reel is engaged against the drive member, it will not unwind to the lengthening of the tape for the attachment. The unwinding is only accomplished by the unwinding of the supply reel, so the take up reel is kept from unwinding too much of the leader at the beginning of the tape as it cannot unwind from the take up reel.

Further, the path of the tape is shorter and easier to handle.

Also, in the third form of the invention, as already described, an opening 133 is provided in the front wall 130 of the cartridge housing 106' between the rollers 101 and 102, so that the sub cartridge can be mounted in the cartridge housing while the tape segment 33', between the reels, is still taut and shortened to an inoperative, storage position, as illustrated in FIG. 28(*b*) in solid lines and designated by numeral 153. The sub cartridge, after being mounted in the cartridge housing, can be allowed to pivot back into engagement with the drive member, before the tape segment is drawn out through the opening 133 and attached or looped about the rollers and retightened in operative position by rewinding the supply reel. The take up reel will not unwind any of its tape on its reel during this, as its engagement with the drive member is sufficient to prevent its rotation by this action.

Also, the other species of the invention, other than the third form have similar pins 154 and slots 154' fixed respectively to the upper and lower extension flanges 150 and 150' of the upper and lower panels of the sub cartridges of the other species. The pins frictionally engage in the slots in the columns fixed to the panels or flanges to fix the pins and columns together and thereby fix the upper and lower flanges of the sub cartridge together in fixed, spaced relation for more accurate spacing between the reels, and thereby more even winding of the tape onto the take up reel.

In this second continuation in part, the felt frictional strips extend radially, but also extend outward in the direction of the last feed roller, such as rollers 47, 103, and the last left rollers in species 2 and 4, to feed the tape onto the take up reel so as to be as near as possible to these feed rollers.

This is to enable the felt members to support the tape immediately after it leaves the last feed roller until it is wound onto the particular take up reel; so that the tape won't sag in the middle after leaving the last roller while traveling to the take up reel and thus will wind more evenly onto the take up reel. The felt extends to the last feed roller in a manner so that it will support the tape for as much of the distance as possible from the time it leaves the last feed roller until it reaches the take up reel, from the beginning of the winding when the diameter of the wound tape on the take up reel is rather small throughout to the end of the winding when the diameter of the tape on the take up reel is rather large.

Also, the felt strips adjacent each side of the drive member, when it engages the take up reel, are positioned to be near each side of the drive member to assist in maintaining the tape or ribbon in alignment on the reel before and after it is engaged by the drive member to drive the tape onto the reel.

The flanges or legs 150 and 150' of the sub cartridge panels form slots 150", extending inwardly from the outer edges of the panels of the sub cartridges to the reels of the sub cartridges of the different species, that receive the spoke member therein as seen by the drawings.

Also, the center opening 158 is being provided in the other species in the front wall of the cartridge housing between the arms of the spaced guide members, similar to the opening 133 shown in connection with the third species. The opening makes it easier to draw out and loop, encircle, or attach the intermediate ribbon portion 33' about the spaced ribbon guides, as already previously discussed in connection with the third specie.

Also, the flange 155 is fixed to the top of the back wall of the cartridge housing in the third species and extends over the top of the sub cartridge, when the sub cartridge is mounted in the housing and its tape is being driven by the drive member. The flange aligns with a slot in the bottom edges of the panels of the sub cartridge to allow the sub cartridge to be removed upward, when the sub cartridge is pivoted fully away from the drive member.

It is not intended that the invention be limited by specie except as follows:

It will be obvious that various changes and departures may be made to the invention without departing from the spirit and scope thereof, and accordingly, it is not intended that the invention be limited to that specifically described in the specification or as illustrated in the drawings, but only as set forth in the appended claims wherein:

What is claimed is:

1. A loop attaching ribbon cartridge device comprising an outer detachable housing and an inner unitary loop attaching ribbon cartridge having an elongated ribbon therein, and wherein said inner cartridge is detachably carried in said housing and said housing is adapted to be carried in a device for driving said ribbon of said inner cartridge;

said outer housing having a base with a front and a rear with spaced arm means mounted along the front of the base, said arm means having end portions projecting frontally outward with ribbon guide means at the end portions of said spaced arm means;

said inner cartridge having a pair of panels, a pair of bearing supports fixed between said panels, a pair of reels rotatably mounted to said pair of bearing supports, said elongated ribbon having a pair of remote ends with one end wound onto one of said reels and its other end permanently attached to the other of said reels and having an intermediate portion between said reels, said reels and said ends of said ribbon being between and within the confines of said pair of panels, connecting means connecting said pair of panels fixed together as a unitary structure with openings between said connecting means to allow said intermediate portion of said ribbon to extend outside the confines of said panels and in front of said inner cartridge;

a sliding cartridge carriage slidably mounted to the base of said outer housing, said inner cartridge being detachably carried as a unitary structure on said sliding carriage;

said housing having an opening in front of said inner cartridge sufficient to enable said intermediate ribbon portion to be freely grasped and looped about said ribbon guide means of said housing while said inner cartridge is carried on said sliding carriage and while the ends of said ribbon remain within the confines of said inner cartridge;

said ribbon guide means of said outer housing being adapted to receive and guide said intermediate ribbon portion of said inner cartridge when said inner cartridge is carried on said sliding carriage from said one reel in a loop about said guide means to said other of said reels;

said outer housing having peripheral drive means for driving said ribbon and adapted to be driven by said device, spring means on said outer housing urging said carriage toward said peripheral drive means;

handle means mounted to an outer portion of said carriage and extending outward away from said carriage and said housing for sliding said carriage along said base;

latch means mounted to said outer housing and a release lever mounted to said latch means for releasing said latch means; said latch means having spring means urging said latch means into an engaging position with said carriage to lock said carriage, when said carriage has been slid away from said peripheral drive means, from sliding toward said peripheral drive means, said release lever releasing said latch means from said carriage whereby said carriage may slide toward said peripheral drive means of said outer housing.

2. A ribbon cartridge comprising an outer housing having a base with a front and a rear with a left front, near right front, and a far right ribbon guide means mounted spaced along a left front, a near right front, and a far right front, respectively, of the base of said housing, said housing having an opening along the front of the base between the left front and near right front ribbon guide means;

a spoke drive member rotatably mounted to the base of said housing rearward of the near right front ribbon guide means;

a unitary cartridge having a pair of reels with a ribbon having opposite ends with one end attached to one of said reels and the other end attached to the other of said reels, said cartridge having a pair of laterally spaced panels with a longitudinally spaced pair of bearing supports fixed to one of said panels and rotatably supporting said pair of reels between said panels with one of said reels spaced from the other, said panels being fixed together spaced laterally of one another as a single unitary structure, said ribbon having an intermediate portion between its ends positioned between the reels and outside the confines of said panels;

a cartridge support pivot plate pivotally mounted to the base of said outer housing, said unitary cartridge and pivot plate having cooperating engaging means to enable said plate to downwardly receive and upwardly remove said cartridge from said plate and to detachably carry said cartridge on top of said plate in said outer housing as a single unit, said plate with said cartridge thereon being pivotable along the base toward the spoke member of the housing to the rear of said near right ribbon guide means of said housing, to thereby pivot said other reel of said cartridge into engagement peripherally with said spoke member of said housing for driving said ribbon peripherally onto said other reel of said cartridge;

said cartridge having slots extending longitudinally in from outer edges of said panels toward the center axes of the bearing supports and reels to enable said panels to peripherally receive said spoke member of said housing into engagement with said other reel between said panels of said cartridge;

spring means in said housing urging said pivot plate pivotally toward said spoke member of said housing to maintain said other reel of said cartridge peripherally engaged to said spoke member of said outer housing under the urging of said spring means;

said housing having said opening along the front of its base between the left front and near right front ribbon guide means of a size sufficient to enable said intermediate ribbon portion to be freely grasped and looped about said spaced left front and far right front ribbon guide means and about said near right front ribbon guide means while said cartridge is carried on said pivot plate in said housing and while the ends of said ribbon remain within,the confines of the panels of said cartridge;

said spaced ribbon guide means of said outer housing being adapted to receive and guide said intermediate ribbon portion of said cartridge when said cartridge is carried on said pivot plate from said one reel in a loop about said guide means to said other of said reels;

handle means mounted to said pivot plate and extending outward from said plate and housing for pivoting said plate in said housing.

3. A ribbon cartridge according to claim 2, wherein said cartridge panels of said unitary cartridge have substantially identical reverse opposing ends adjacent said supports and reels with said slots extending into both of said reels, said panels both having confronting inner frictional surfaces adjacent both of said reels so to engage the edges of the ribbon wound on both of said reels simultaneously to provide simultaneous drag and tension upon the ribbon on both reels in both directions whereby the cartridge may be reversably mounted in the housing to enable the spoke member of the housing to drive the ribbon in either direction on the reels.

4. A method of attaching a unitary inner ribbon carrying cartridge to an outer cartridge housing carrying a peripheral drive and spaced ribbon guides for subsequent attachment of both said inner cartridge and outer housing to an apparatus for printing from a ribbon, wherein said apparatus has means to power said peripheral drive of said outer housing to drive said ribbon of said inner cartridge past printing means on the apparatus for printing, and wherein said ribbon carrying inner cartridge has a pair of laterally spaced panels and a pair of reels between said panels rotatably supported by support means on said panels, with said panels being fixed together in unitary spaced relation, with a reel of said ribbon having its one end fixed to one of said reels and its other end wound onto the other reel, and with an intermediate portion of said ribbon between the ends outside the confines of said panels and the ends of the ribbon confined between the panels;

said method of attaching comprising the steps of attaching said unitary inner cartridge onto said outer cartridge housing as a single unitary structure with said peripheral drive of said outer housing and said one reel of said inner cartridge positioned away from one another;

engaging said peripheral drive of said outer housing and said one reel of said inner cartridge relative to one another for driving said ribbon;

drawing said intermediate portion of said ribbon of said inner cartridge away from said reels and inner cartridge and looping said intermediate portion about said spaced ribbon guides of said outer cartridge housing while said ends of said ribbon remain attached to said reels between said panels of said inner cartridge;

and attaching said outer cartridge housing with said inner cartridge thereon onto said apparatus with said inner cartridge attached to said housing and with said intermediate portion looped about said ribbon guides of said outer cartridge housing.

5. A ribbon cartridge including a a loop attaching unitary cartridge and outer housing, said loop attaching unitary cartridge being inserted into said outer housing, said outer housing being insertable into a ribbon driving device for the operation thereof, and wherein said outer housing has a peripheral drive adapted to be driven by said ribbon driving device and has a horizontal base with a front edge and vertical sloe walls and a plurality of spaced ribbon guide means along the front edge of the base and spaced from one another along the front edge with an opening along the front edge between the guide means;

said loop attaching unitary cartridge comprising a pair of elongated panels spaced laterally from one another, a pair of bearing supports fixed to said panels at intervals between the panels, a pair of reels rotatably mounted on said bearing supports between said pair of panels, an elongated ribbon having a pair of ends with one of said ends wound onto one of said reels and the other end permanently affixed to the other of said reels, said ends being inside the confines of said panels, said ribbon having an intermediate portion outside the confines of said panels, said pair of elongated panels having a lateral portion between the panels along a front edge of said panels and supporting in spaced relation said intermediate portion In front of and outside the confines or said panels, so that said unitary cartridge may be detachably mounted onto said outer housing as a single unitary structure and the intermediate portion of said ribbon will be accessable along the front edge of said unitary cartridge and outside the cartridge from said opening in front of said outer housing, so that it can be grasped, drawn, and looped about said spaced ribbon guide means on the front of said outer housing with the ends of said ribbon remaining inside the confines of said panels of said cartridge, means for moving said unitary cartridge into engagement with said peripheral drive, said one reel of said cartridge being adapted to to receive said peripheral drive of said outer housing in response to said movement of said unitary cartridge for said peripheral drive to drive said ribbon onto said one reel from said other reel of said cartridge.

* * * * *